US006504522B2

(12) United States Patent
Shiraki et al.

(10) Patent No.: US 6,504,522 B2
(45) **Date of Patent: *Jan. 7, 2003**

(54) ACTIVE-MATRIX-TYPE IMAGE DISPLAY DEVICE

(75) Inventors: Ichiro Shiraki, Tenri (JP); Yasushi Kubota, Sakurai (JP); Tamotsu Sakai, Tenri (JP)

(73) Assignee: Sharp Kabushiki Kaisha (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/088,821

(22) Filed: Jun. 2, 1998

(65) Prior Publication Data

US 2001/0011983 A1 Aug. 9, 2001

(30) Foreign Application Priority Data

Jun. 4, 1997 (JP) ..... 9-146826
Mar. 25, 1998 (JP) ..... 10-077992

(51) Int. Cl.[7] ..... G09G 3/20
(52) U.S. Cl. ..... 345/98; 345/100; 345/94
(58) Field of Search ..... 345/89, 92, 147, 345/95, 94, 99, 96, 98, 100

(56) References Cited

U.S. PATENT DOCUMENTS 4,743,096 A * 5/1988 Wakai et al. ..... 350/333
5,196,738 A * 3/1993 Takahara et al. ..... 307/296.1
5,583,531 A * 12/1996 Okada et al. ..... 345/89
5,583,535 A * 12/1996 Takarada et al. ..... 345/99
5,621,426 A * 4/1997 Okada et al. ..... 345/95
6,002,384 A * 12/1999 Tamai et al. ..... 345/95
6,067,066 A * 5/2000 Kubota et al. ..... 345/100
6,160,533 A * 12/2000 Tamai et al. ..... 345/89
6,172,663 B1 * 1/2001 Okada et al. ..... 345/96
6,271,817 B1 * 8/2001 Wakai et al. ..... 345/91

FOREIGN PATENT DOCUMENTS

JP 62-147488 7/1987
JP 6-130916 5/1994

* cited by examiner

*Primary Examiner*—Richard Hjerpe
*Assistant Examiner*—Kevin M. Nguyen
(74) *Attorney, Agent, or Firm*—George W. Neuner; Edwards & Angell, LLP

(57) ABSTRACT

An active-matrix-type image display device having a gray-scale power supply for generating gray-scale voltages of different levels, and a source driver that applies gray-scale voltages according to a digital picture signal to source lines and includes one scanning circuit for each source line. The outputs of the scanning circuits are sequentially made active once in a horizontal period. A latch circuit fetches the digital picture signal in synchronization with making the output of the scanning circuit active. The digital picture signal is decoded by a decoder circuit, and one of analog switches becomes a conducting state according to the decoded signal. As a result, one of the gray-scale voltages is output to the source line.

17 Claims, 18 Drawing Sheets

FIG. 11

| $L_{out1}$ | $L_{out2}$ | $L_{out3}$ | SELECTING VOLTAGE |
|---|---|---|---|
| 0 | 0 | 0 | $V_1$ |
| 0 | 0 | 1 | $V_2$ |
| 0 | 1 | 0 | $V_3$ |
| 0 | 1 | 1 | $V_4$ |
| 1 | 0 | 0 | $V_5$ |
| 1 | 0 | 1 | $V_6$ |
| 1 | 1 | 0 | $V_7$ |
| 1 | 1 | 1 | $V_8$ |

ACTIVE-MATRIX-TYPE IMAGE DISPLAY DEVICE

FIELD OF THE INVENTION

The present invention relates to an active-matrix-type image display device including a plurality pixels arranged in a matrix form, a plurality of data signal lines arranged to correspond to the columns of the pixels, and a plurality of scanning signal lines arranged to correspond to the rows of the pixels, for displaying an image by supplying picture signals from the data signal lines in synchronization with scanning signals supplied from the scanning signal lines. More particularly, the present invention relates to an active-matrix-type image display device capable of providing a gray-scale display using a gray-scale voltage.

BACKGROUND OF THE INVENTION

A conventional active-matrix liquid crystal display device is a known example of the active-matrix-type image display device. As illustrated in FIG. 15, the conventional active-matrix liquid crystal display device includes a plurality of source lines SL, gate lines GL, a source driver 52 connected to the source lines SL, and a gate driver 53 connected to the gate lines GL. A pixel 60 is provided in each region enclosed by adjacent source lines SL and adjacent gate lines GL. The pixels 60 form a pixel array 51 in the form of a matrix.

The source driver 52 samples a picture signal DAT input in synchronization with timing signals such as a clock signal CKS and a start signal SPS, and applies the picture signal DAT to the source lines SL, after amplifying it if necessary. The gate driver 53 sequentially selects a gate line GL in synchronization with timing signals such as a clock signal CKG and a start signal SPG. When the switching elements in the pixels 60 connected to the selected gate line GL are turned ON, the picture signal DAT applied to the source lines SL is supplied to the pixels 60. Each pixel 60 has an electrostatic capacity, and stores the picture signal DAT supplied.

By the way, in the conventional active-matrix liquid crystal display device, in general, the source driver 52 and gate driver 53 are provided as an external IC. By contrast, in order to reduce the packaging cost and improve the packaging reliability, as shown in FIG. 16, for example, a technique for producing a monolithic structure by forming the pixel array 51 and driving circuits, such as the source driver 52 and gate driver 53, on a single insulating substrate 57 was reported recently. A power supply circuit 55, and a control circuit 54 for supplying various control signals are connected to the driving circuits.

The following description will explain an example of the structure of the source driver 52 for displaying an image corresponding to input digital picture signals, in the conventional active-matrix liquid crystal display device. In this example, a multiplexer-type structure is adopted. According to the multiplexer-type structure, more than one kind of gray-scale voltages supplied from external devices are selected, and applied to the source lines without amplifying the voltages by an amplifier or the like. In order to simplify the explanation, it is assumed that the digital picture signals to be input are 3 bits (8 gray scales).

As illustrated in FIG. 17, the conventional source driver 52 includes one scanning circuit 61 and three latch circuits 62*a*, 62*b*, 62*c*, three transfer circuits 65*a*, 65*b*, 65*c*, one decoder circuit 63, and eight analog switches 64*a* through 64*h*, with respect to a single stage, i.e., a single source line SL. Supplied to each stage are 3-bit digital picture signals $DAT_1$ through $DAT_3$, a transfer signal TRP, and eight kinds of gray-scale voltages $V_1$ through $V_8$ as well as the clock signal CKS and start signal SPS. For example, the scanning circuit 61, the latch circuits 62*a*, 62*b*, 62*c*, and the decoder circuit 63 are formed by a shift register, half-bit latch circuits, and eight AND circuits, respectively.

Referring now to FIG. 18, the following description will explain the operation of the source driver 52. Here, in order to simplify the explanation, let's look at only the three source lines, $SL_1$ through $SL_3$. $GL_1$ and $GL_2$ in FIG. 18 are the waveforms of the scanning signals supplied from the gate driver 53 to the gate lines $GL_1$ and $GL_2$, respectively.

In a horizontal period $T_1$, the source driver 52 fetches the digital picture signals $DAT_1$ through $DAT_3$ when the latch circuits 62*a*, 62*b*, 62*c* are opened and closed in synchronization with an output Q of the scanning circuit 61. In a horizontal flyback period subsequent to the horizontal period $T_1$, the transfer signal TRP becomes active, and the digital picture signals $DAT_1$ through $DAT_3$ fetched in the horizontal period $T_1$ are transferred at a time to the decoder circuit 63 from the transfer circuits 65*a*, 65*b*, 65*c*. The digital picture signals $DAT_1$ through $DAT_3$ transferred to the decoder circuit 63 at a time are decoded into 8-bit signals in the decoder circuit 63, and supplied to analog switches 64*a* through 64*h*, respectively. Then, one of the gray-scale voltages $V_1$ through $V_8$ is selected, and output to the source lines SL in a horizontal period $T_2$. Thus, the digital picture signals corresponding to a single horizontal scanning period fetched in the scanning period $T_1$ are output at a time in the next horizontal period $T_2$ by the source driver 52.

However, the above-mentioned conventional structure suffers from the following drawbacks. Namely, in this structure, since a single gray-scale voltage needs to be output to all of the source lines SL at a time, the peak of a current flowing in a gray-scale voltage line (the line to the source driver 52 from a gray-scale power supply for generating the gray-scale voltage) in the period shown by $t_{trf}$ in FIG. 18 is several tens milliampere. In other words, since the gray-scale power supply is required to produce a driving force satisfying such a condition, the overall power consumption of the liquid crystal display device becomes inevitably very high. Moreover, the component parts of the gray-scale power supply are required to have a high withstanding voltage, resulting in an increase in the production cost.

In resent years, portable information terminals are in widespread use. In such a situation, the demand for a liquid crystal display as a display device of the portable information terminals are increasing because of the thinness of the liquid crystal display device. Since most of the portable information terminals are driven by butteries, the display devices for use in such terminals are strongly required to consume low power.

SUMMARY OF THE INVENTION

It is an object of the present invention to provide a low-power-consuming active-matrix-type image display device by reducing, particularly, the power consumption of a gray-scale power supply.

In order to achieve the above object, an active-matrix-type image display device for inputting a digital picture signal, according to the present invention, includes:

- a plurality of pixels arranged in a matrix form;
- a plurality of data signal lines arranged to correspond to the columns of the pixels;

a plurality of scanning signal lines arranged to correspond to the rows of the pixels;

gray-scale voltage generating means for generating gray-scale voltages of different levels;

a scanning signal line driving circuit for outputting a scanning voltage to the scanning signal lines; and a data signal line driving circuit for selecting a gray-scale voltage according to the picture signal and outputting the gray-scale voltage to the data signal line, and is characterized by that the data signal line driving circuit has one scanning circuit for each data signal line, and selectively outputs the gray-scale voltage to the data signal lines in synchronization with sequential outputs of active signals from the scanning circuits in one horizontal period.

With this structure, the gray-scale voltage generating means generates gray-scale voltages of different levels corresponding to the number of gray scales of the digital picture signal to be input. The data signal line driving circuit selects a voltage according to the picture signal from the gray-scale voltages of different levels in synchronization with making the scanning circuits corresponding to the data signal lines active sequentially, and outputs the selected voltage to the data signal lines sequentially.

With this structure, since the peak of a current flowing in the gray-scale power supply line for supplying the gray-scale voltage to the data signal line driving circuit from the gray-scale voltage generating means is spread, a smaller driving force is required by the gray-scale voltage generating means as compared to a conventional structure where a single gray-scale voltage is output to all of the data signal lines at a time in one horizontal period. As a result, the power consumption of the gray-scale voltage generating means is reduced, thereby providing a low-power-consuming active-matrix-type image display device.

Moreover, unlike the conventional structure, the present invention does not require a structure for storing and transferring picture signals corresponding to one horizontal period, thereby achieving reduction in the circuit scale. Thus, the structure of the present invention can significantly decrease the area of the circuit, particularly, when the driving circuits are formed using, for example, a polycrystalline silicone thin film. Hence, it is possible to decrease the area of the periphery section (frame section) of the display device, and reduce the number of production steps and the production cost.

Furthermore, the above-mentioned active-matrix-type image display device of the present invention can be constructed so that the gray-scale voltage corresponding to the picture signals fetched in each horizontal period continues to be output to the data signal lines from the data signal line driving circuit until the picture signals are fetched in the next horizontal period.

With this structure, it is possible to use a time substantially equal to one horizontal period as the application time of the gray-scale voltage to the data signal lines, thereby preventing insufficient voltage application to the data signal lines. Consequently, high-quality images are obtained. Besides, in general, it is possible to use a sampling transistor for outputting a gray-scale voltage to the data signal lines. According to the above-mentioned structure, since the sampling transistor does not become inactive, it is possible to prevent variations in the electric potential of the data signal line due to outflow of charges accumulated in the channel region.

Additionally, the above-mentioned active-matrix-type image display device of the present invention can employ a data signal line driving circuit having discharge means for supplying a discharge voltage to the data signal lines.

With this structure, the discharge means applies the discharge voltage to the data signal lines in a period of time from a horizontal flyback period to the fetching of the picture signal in the next horizontal period. The application time of the gray-scale voltage to the last data signal line to which the gray-scale voltage is applied last in a horizontal period is shortest. However, since the discharge time within which the discharge voltage is applied to the last data signal line in the horizontal period is long (substantially one horizontal period). Therefore, the discharge voltage compensates for the insufficient application of the gray-scale voltage. It is thus possible to perform sufficient voltage application to all of the source lines, and provide high-quality images.

As the discharge voltage, it is possible to use on e of the gray-scale voltages generated by the gray-scale voltage generating means.

With this structure, since one of the gray-scale voltages generated by an existing gray-scale power supply is used as the discharge voltage, there is no need to additionally provide a power supply for generating the discharge voltage. Accordingly, it is possible to perform sufficient voltage application to all of the data signal lines without increasing the power consumption and circuit scale.

Furthermore, the discharge means can include a latch circuit which inputs the discharge signal and picture signal and is set or reset when the discharge signal is active, and a selecting circuit for selecting and outputting one of the gray-scale voltages according to the output of the latch circuit, and be constructed so that the latch circuit outputs a signal for selecting a gray-scale voltage used as the discharge voltage to the selecting circuit when the discharge signal is active, and outputs a signal for s electing the gray-scale voltage corresponding to the picture signal to the selecting circuit when the discharge signal is inactive.

With this structure, when the discharge signal is active, the latch circuit is set or reset by the discharge signal, then a signal for selecting the gray-scale voltage to be used as the discharge signal is output. Thus, one of the gray-scale voltages is selected as the discharge voltage, and output to the data signal lines. On the other hand, when the discharge signal is inactive, a signal for selecting a gray-scale voltage according to a picture signal fetched by the latch circuit is supplied to the selecting circuit, then the gray-scale voltage is output to the data signal lines. Accordingly, it is possible to achieve a data signal line driving circuit having a discharge function with a simple structure using the latch circuit.

The above-mentioned active-matrix-type image display device of the present invention can be constructed so that a switching element formed of a polycrystalline silicone thin-film transistor is provided for each pixel, and the data signal line driving circuit and the scanning signal line driving circuit include the polycrystalline silicone thin-film transistors.

With this structure, since the polycrystalline silicone thin film is used as the semiconducting layer of the switching element provided in each pixel, it is possible to significantly increase the mobility compared to a TFT using a noncrystalline silicone thin film. Accordingly, even when a driving method in which the polarity of the voltage to be applied to the data signal is inverted every frame period or every horizontal period, it is possible to perform sufficient voltage application to a data signal line to which the voltage is applied last in a horizontal period, thereby achieving high-quality displays.

In the case when the polycrystalline silicone thin-film transistor is used as mentioned above, the pixels, data signal line drive circuit, and scanning signal line drive circuit can be formed on a single substrate.

According to this structure, by forming switching elements, etc. using polycrystalline silicone thin-film transistors, the driving circuits can be formed on the substrate whereon the pixels are disposed. It is thus possible to decrease the production cost and the packaging cost, and improve the reliability.

Besides, in this case, it is preferred to use a glass substrate as the above-mentioned substrate, and set the maximum temperature in the process of producing the pixels, data signal line driving circuit and scanning signal line driving circuit at 600° C. or lower temperatures.

According to this structure, it is possible to use an inexpensive low-melting-point glass substrate, thereby providing an active-matrix-type image display device at a low cost.

In the above-mentioned active-matrix-type image display device, when the digital picture signal is n bits, the data signal line driving circuit can be constructed using one scanning circuit, n latch circuits, and one data signal line output circuit for each data signal line. For instance, the data signal line driving circuit can be formed by $2^n$ AND circuits, and $2^n$ analog switches.

In this structure, since a transfer circuit that is essential to the conventional structure is not required, it is possible to reduce the circuit scale of the data signal line driving circuit. Moreover, in the case when the driving circuit is formed by using a polycrystalline silicone film that is subject to stricter design rules compared to an LSI, it is possible to significantly decrease the circuit area. Thus, this structure is very effective for the decrease in the area of the periphery section (frame section) of the display device, and reduction in the production cost.

The above-mentioned active-matrix-type image display device can use a resistance type digital-to-analog converter or capacitance type digital-to-analog converter as the above-mentioned gray-scale voltage generating means.

According to this structure, with the use of the resistance type digital-to-analog converter or capacitance type digital-to-analog converter, it is possible to generate gray-scale voltages of different levels from a voltage produced by one voltage generator (or two voltage generators when the resistance type digital-to-analog convertor is used). Consequently, the number of input terminals of the data signal line driving circuit can be reduced, thereby providing a more compact active-matrix-type image display device.

For a fuller understanding of the nature and advantages of the invention, reference should be made to the ensuing detailed description taken in conjunction with the accompanying drawings.

BRIEF DESCRIPTION OF THE DRAWINGS

FIG. 11 is an explanatory view showing the relationship between the outputs of the latch circuits shown in FIGS. 9 and 10, and gray-scale voltages selected according to the outputs.

DESCRIPTION OF THE PREFERRED EMBODIMENTS

Embodiment 1

The following description will explain an embodiment of the present invention with reference to FIGS. 1 to 4.

Figure 2:
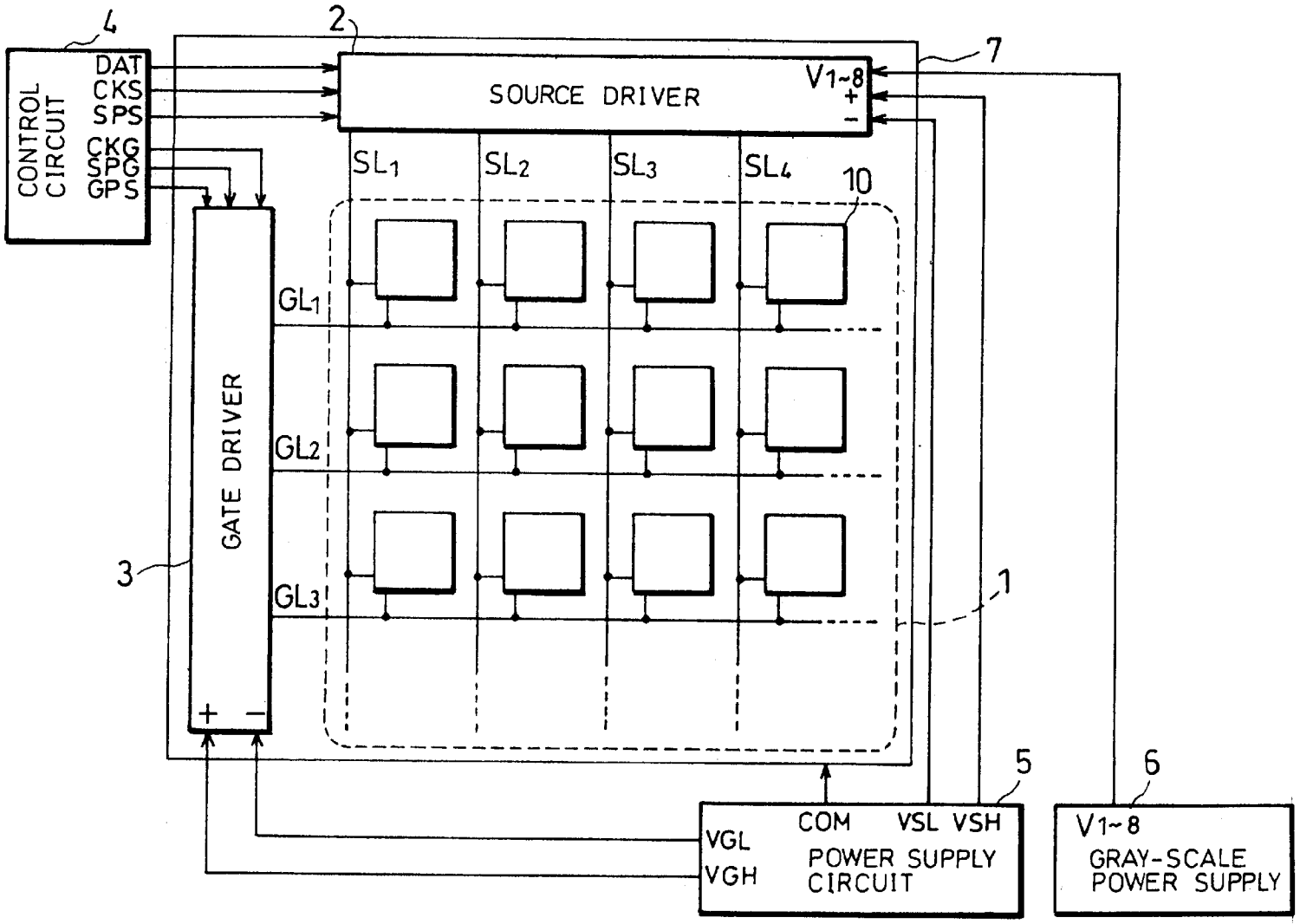
FIG. 2 is a block diagram showing a schematic structure of the active-matrix liquid crystal display device.

Here, an active-matrix liquid crystal display device is explained as an example for implementing the present invention. As illustrated in FIG. 2, this active-matrix liquid crystal display device includes a pixel array 1, a source driver 2, a gate driver 3, a control circuit 4, a power supply circuit 5, and a gray-scale power supply 6 (gray-scale voltage generating means).

The pixel array 1, source driver 2, and gate driver 3 are formed on an insulating substrate 7. The insulating substrate 7 is made of a material having insulating and light transmitting properties, for example, glass. A liquid crystal panel is formed by fastening the insulating substrate 7 and a counter substrate (not shown) together, and sealing liquid crystals (not shown) in a space therebetween.

A number of source lines SL (data signal lines) are connected to the source driver 2 (data signal line driving circuit), while a number of gate lines GL (scanning signal lines) are connected to the gate driver 3 (scanning signal line driving circuit). The source lines SL and gate signal lines GL are arranged to cross each other at right angles. One pixel 10 is mounted in each region enclosed by two adjacent source lines SL and two adjacent gate lines GL. Namely, the pixels 10 constituting the pixel array 1 are arranged in a matrix form.

Figure 3:
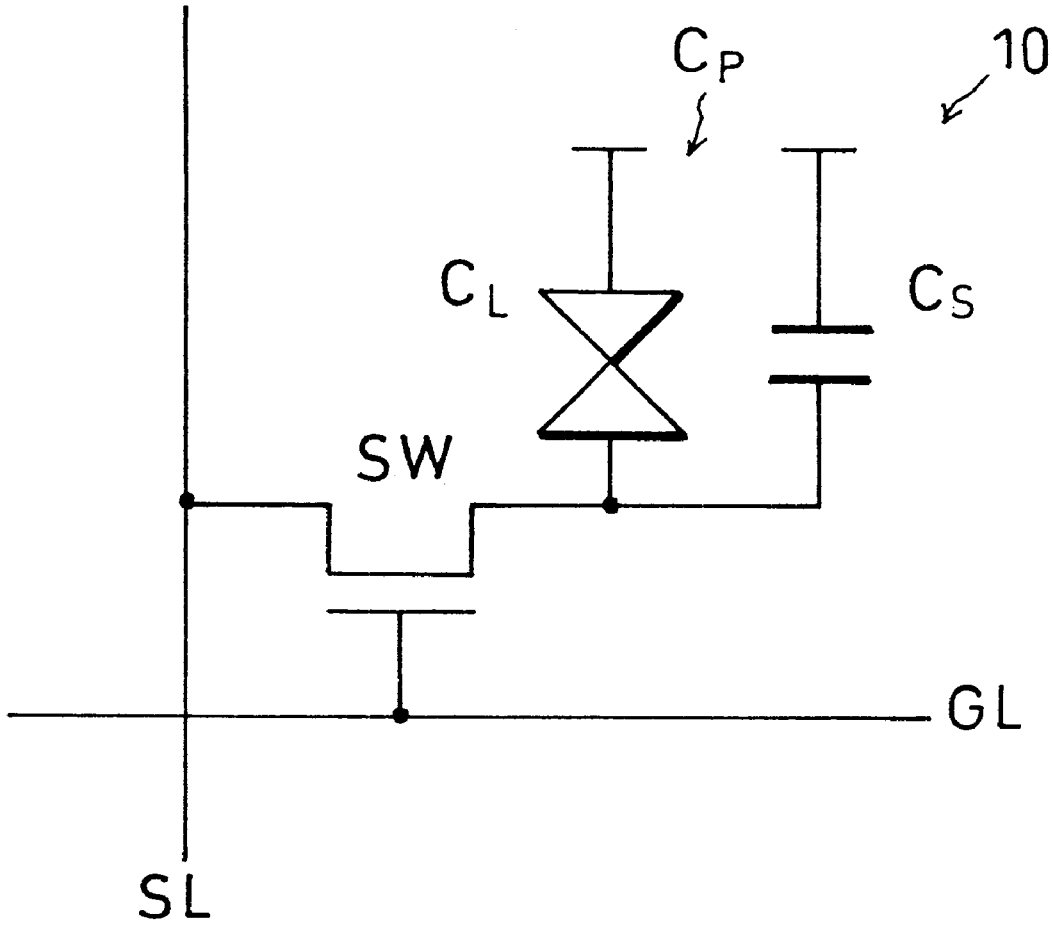
FIG. 3 is a circuit diagram showing the structure of a pixel of the active-matrix liquid crystal display device shown in FIG. 2.

As illustrated in FIG. 3, the pixel 10 includes a switching element SW formed of, for example, a field effect transistor, and a pixel capacitor $C_P$. The pixel capacitor $C_P$ is formed by a liquid crystal capacitor $C_L$, and a supplemental capacitor $C_S$ that is added if necessary.

The source line SL is connected to one of the electrodes of the pixel capacitor $C_P$ through the source and drain of the switching element SW. The gate of the switching element SW is connected to the gate line GL. The other electrode of the pixel capacitor $C_P$ is connected to a common electrode line (not shown) that is shared by all the pixels 10. The transmittance or reflectance of the liquid crystals are modulated according to a voltage applied to each liquid crystal capacitor $C_L$, thereby displaying an image.

The source driver 2 selects one gray-scale voltage from a plurality of gray-scale voltages output from the gray-scale power supply 6, according to a digital picture signal DAT, a clock signal CKS and a start signal SPS input from the control circuit 4, and outputs the selected gray-scale voltage to a single source line SL only for a predetermined period. The detail explanation of the source driver 2 will be given later.

The gate driver 3 selects the gate lines GL sequentially according to control signals CKG, SPG, GPS from the control circuit 4, and controls the opening and closing of the switching elements SW in the pixels 10. Consequently, data (gray-scale signals) applied to the source lines SL are supplied to the pixels 10. The supplied data are stored in the pixels 10.

The control circuit 4 outputs the digital picture signal DAT, clock signal CKS and start signal SPS to the source driver 2, and control signals CKG, SPG, GPS to the gate driver 3. Moreover, the control circuit 4 outputs various control signals necessary for selecting a gray-scale voltage.

The power supply circuit 5 is a circuit for generating power supply voltages $V_{SH}$, $VS_{SL}$, $V_{GH}$, $V_{GL}$, and a common electric potential COM. The power supply voltages $V_{SH}$ and $V_{SL}$ are voltages of different levels, and applied to the source driver 2. The power supply voltages $V_{GH}$ and $V_{GL}$ are voltages of different levels, and applied to the gate driver 3. The common electric potential COM is applied to a common electrode line mounted on a counter substrate (not shown).

The gray-scale power supply 6 includes a plurality of voltage generating circuits (not shown) for generating gray-scale voltages of different levels. The gray-scale voltages are applied to the source driver 2. In this embodiment, for the sake of simplifying the explanation, a 3-bit signal is input as the digital picture signal DAT so as to provide a 8-gray-scale display. Accordingly, the gray-scale power supply 6 generates gray-scale voltages $V_1$ through $V_8$.

Figure 1:
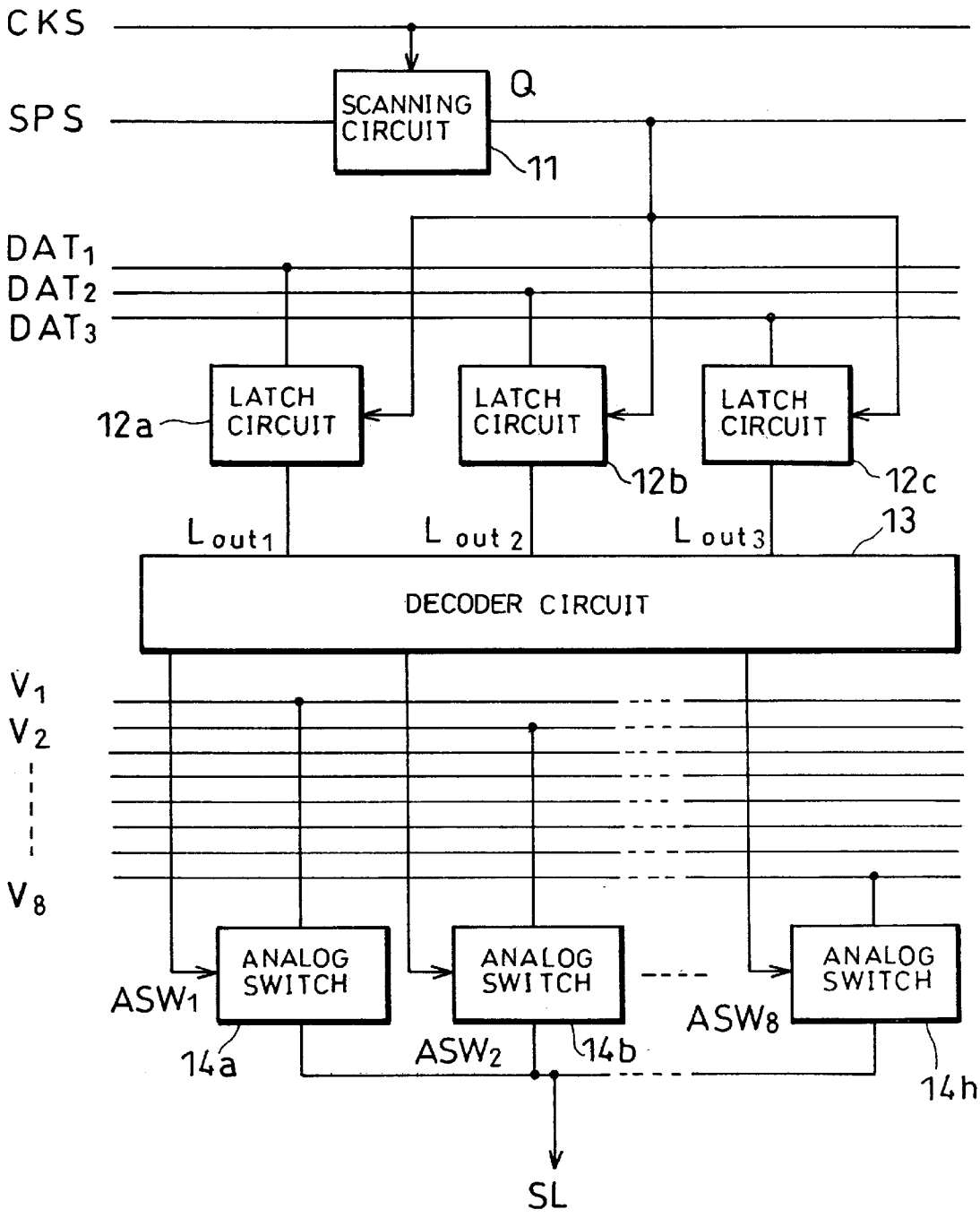
FIG. 1 is a block diagram showing the structure of a source driver of an active-matrix liquid crystal display device according to one embodiment of the present invention.

The following description will explain the structure of the source driver 2 in detail. As illustrated in FIG. 1, the source driver 2 includes one scanning circuit 11, three latch circuits 12*a*, 12*b*, 12*c*, one decoder circuit 13, and eight analog switches 14*a* through 14*h* for one stage, i.e., one source line 1. The decoder circuit 13 and analog switches 14*a* through 14*h* form a data signal line output circuit. 3-bit digital picture signals $DAT_1$ through $DAT_3$ and eight kinds of gray-scale voltages $V_1$ through $V_8$ as well as the clock signal CKS and start signal SPS are supplied to each stage.

The scanning circuit 11 is formed of, for example, a shift register, and supplies an output Q for controlling the opening and closing of the latch circuits 12*a*, 12*b*, 12*c*, according to the clock signal CKS and start signal SPS from the control circuit 4. The outputs Q of the scanning circuits 11 provided for the respective source lines SL become active sequentially in one horizontal period.

Figure 4:
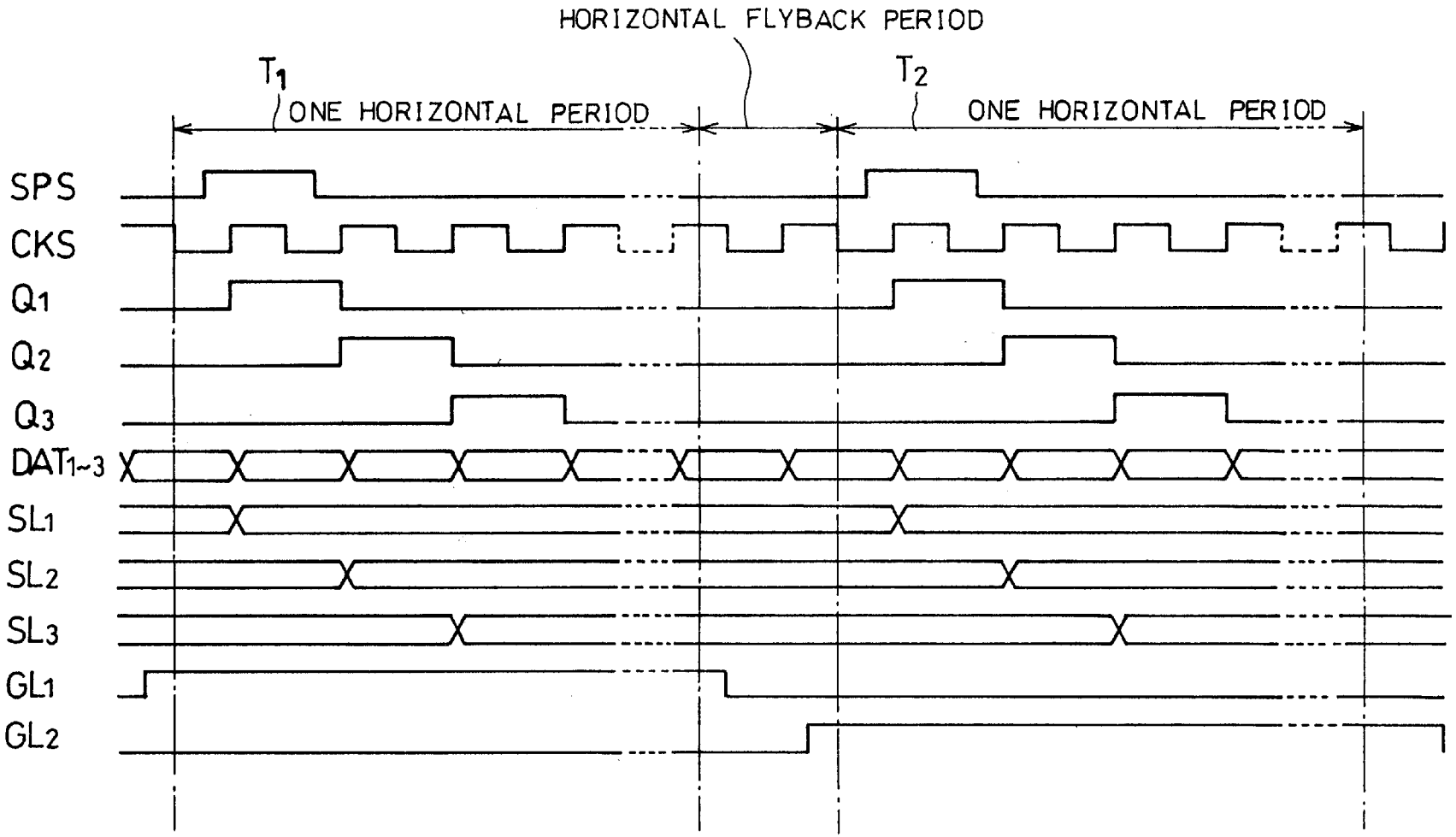
FIG. 4 is a timing chart showing the waveforms of input/output signals with respect to the source driver shown in FIG. 11 and the waveforms of signals in the source driver.

More specifically, as shown in FIG. 4, in a horizontal period $T_1$, when the start signal SPS becomes active, first, an output $Q_1$ of a scanning circuit 11 corresponding to a source line $SL_1$ becomes active. Then, an output $Q_2$ of a scanning circuit 11 corresponding to a source line $SL_2$ becomes active. Thereafter, an output $Q_3$ of a scanning circuit 11 corresponding to a source line $SL_3$ becomes active.

The latch circuits 12*a*, 12*b*, 12*c* are half-bit latch circuits. The latch circuits 12*a*, 12*b*, 12*c* open and close in synchronization with the outputs Q of the scanning circuit 11 so as to fetch the digital picture signals $DAT_1$ through $DAT_3$, and output them as outputs $L_{out1}$ through $L_{out3}$ to the decoder circuit 13.

The decoder circuit 13 is formed by $2^3$ or eight AND circuits, generates decoded signals $ASW_1$ through $ASW_8$ based on the digital picture signals DAT, through $DAT_3$ fetched as the outputs $L_{out1}$ through $L_{out3}$, and outputs them to analog switches 14*a* through 14*h*. Only one of the decoded signals $ASW_1$ through $ASW_8$ from the decoder circuit 13 becomes active. Therefore, only one of the analog switches 14*a* through 14*h* is in a conducting state, and only one of the gray-scale voltages $V_1$ through $V_8$ is output to the source lines SL.

Referring now to FIG. 4, the following description will explain the operation of the source driver 2. Here, in order to simplify the explanation, let's look at only three of the source lines, $SL_1$ through $SL_3$. In FIG. 4, $SL_1$ through $SL_3$ represent the waveforms of the signals output from the source driver 2 to the three source lines $SL_1$ through $SL_3$, respectively. Furthermore, $Q_1$ through $Q_3$ in FIG. 4 show the waveforms of the output signals from the scanning circuits corresponding to the source lines SL, through $SL_3$, respectively, and $GL_1$ and $GL_2$ are the waveforms of signals output to the gate lines $GL_1$ and $GL_2$from the gate driver 3, respectively.

As illustrated in FIG. 4, the outputs $Q_1$ through $Q_3$ are sequentially output from the scanning circuits 11 corresponding to the source lines $SL_1$ through $SL_3$, according to the clock signal CKS and start signal SPS. Specifically, first, the output $Q_1$ from the scanning circuit 11 corresponding to the source line $SL_1$ becomes active only for a predetermined period. Subsequently, the outputs $Q_2$ and $Q_3$ from the scanning circuits 11 corresponding to the source lines $SL_2$ and $SL_3$ become active sequentially only for the predetermined time.

The latch circuits 12*a*, 12*b*, 12*c* corresponding to the source line $SL_1$fetch the digital picture signals $DAT_1$ through $DAT_3$ when the output $Q_1$ becomes active. The latch circuits 12*a*, 12*b*, 12*c* continue to output the digital picture signals $DAT_1$ through $DAT_3$ as the outputs $L_{out1}$ through $L_{out3}$ to the decoder circuit 13 while storing them, until the output $Q_1$ becomes active again in the next horizontal period. Hence, a gray-scale voltage $V_x$ (X=1, 2, 3, 4, 5, 6, 7 or 8) corresponding the digital picture signals DAT, through $DAT_3$ starts to be output to the source line $S_{L1}$ when the output $Q_1$ becomes active in one horizontal period, and continues to be output to the source line $SL_1$until the output $Q_1$ becomes active again in the next horizontal period.

Similarly, the latch circuits 12*a*, 12*b*, 12*c* corresponding to the source lines $SL_2$ and $SL_3$ fetch the digital picture signals $DAT_1$ through $DAT_3$ when the outputs $Q_2$ and $Q_3$ become active. The latch circuits 12*a*, 12*b*, 12*c* store the fetched digital picture signals $DAT_1$ through $DAT_3$ until the outputs $Q_2$ and $Q_3$ become active in the next horizontal period, and then output them to the decoder circuit 13.

Therefore, after the output $Q_2$ becomes active in one horizontal period, the gray-scale voltage $V_x$ (X=1, 2, 3, 4, 5, 6, 7 or 8) corresponding to the digital picture signals $DAT_1$ through $DAT_3$ continues to be output to the source line $SL_2$ until $Q_2$ becomes active again in the-next horizontal period. Similarly, after the output $Q_3$ becomes active in one horizontal period, the gray-scale voltage $V_x$ (X=1, 2, 3, 4, 5, 6, 7 or 8) corresponding to the digital picture signals $DAT_1$ through $DAT_3$ continues to be output to the source line $SL_3$ until $Q_3$ becomes active again in the next horizontal period.

The gray-scale voltage $V_x$ output to the source line $SL_1$ through $SL_3$ are supplied to the pixels 10 connected to a gate line GL that is active in each horizontal period. For example, in the horizontal period $T_1$ shown in FIG. 4, since the gate line $GL_1$ is active, the gray-scale voltage $V_x$ output to the source lines SL is supplied to the pixels 10 connected to the gate line $GL_1$. In the horizontal period $T_2$, since the gate line $GL_2$ is active, the gray-scale voltage $V_x$ output to the source lines SL is supplied to the pixels 10 connected to the gate line $GL_2$.

As described above, in the liquid crystal display device of this embodiment, the output from the source driver 2 to the source lines SL is synchronized with the output Q of the scanning circuit provided for each source line SL. With this structure, the peak of the current flowing in the gray-scale power supply line is spread as compared to a conventional structure in which a single voltage is simultaneously output to all of the source lines, thereby achieving reduction in the driving force required by the gray-scale power supply 6 for generating the gray-scale voltages $V_1$ through $V_8$. As a result, the power consumption of the gray-scale power supply 6 is reduced, and the cost of component parts of the gray-scale power supply 6 is decreased. Accordingly, it is possible to restrain the overall power consumption of the liquid crystal display device, and decrease the production cost.

When adopting a driving method in which the polarity of the voltage to be applied to the source lines SL is inverted every frame period or every horizontal period, there may be shortcomings in the application of the gray-scale voltage, particularly in the application of the gray-scale voltage to the last source line SL (to which the gray-scale voltage is applied last) in the horizontal period. However, such a problem can be avoided by forming, as shown in FIG. 3, the switching element in the pixel 10 by a transistor using a polycrystalline silicon thin film capable of producing a strong driving force.

Furthermore, the source driver 2 of the liquid crystal display device of this embodiment does not require transfer circuits 65*a*, 65*b*, 65*c*, which are essential for the conventional structure, thereby achieving reduction in the circuit scale. In particular, when forming the source drive 2 using a polycrystalline silicon thin film that is subject to stricter design rules compared to an LSI, it is possible to significantly decrease the circuit area by adopting the circuit structure of this embodiment. Thus, this circuit structure is very effective for the decrease in the area of the display's periphery section (frame section) of the liquid crystal display device, and reduction in the production cost.

Figure 19:
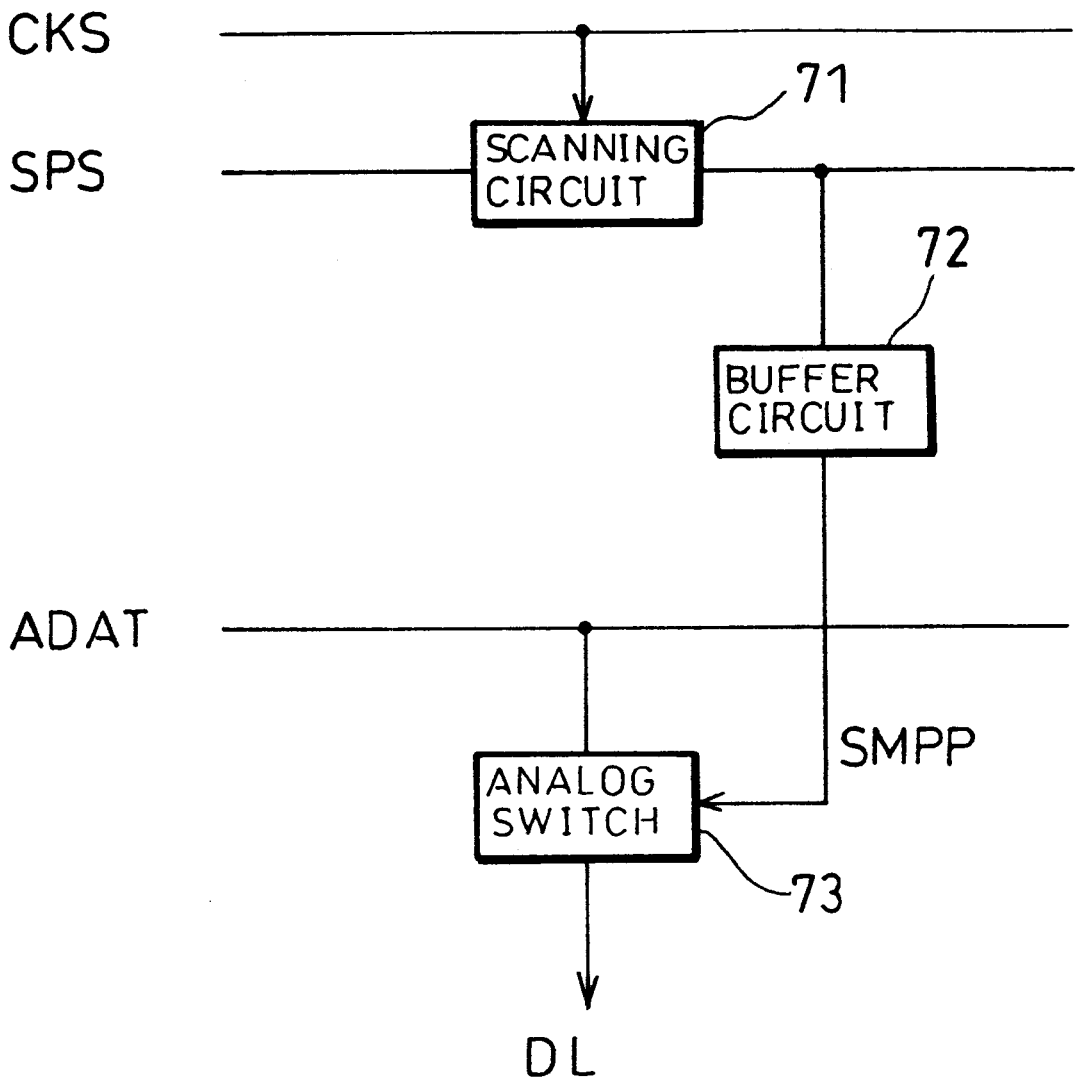
FIG. 19 is a block diagram showing an example of the structure of a data signal line driving circuit of a liquid crystal display device using analog data as picture signals.

Meanwhile, in the conventional liquid crystal display device, in order to supply picture signals as analog data to the data signal lines, a structure using a data signal line driving circuit like the one shown in FIG. 19 has been known. This data signal line driving circuit includes one scanning circuit 71, one buffer circuit 72, at least one analog switch 73 (sampling transistor) for one stage, i.e., one data signal line DL. The output from each stage of the scanning circuit 71 is amplified in the buffer circuit 72, and functions as a sampling signal SMPP to open and close the analog switch 73. As a result, the analog picture signal ADAT is supplied to the data signal line DL.

The above-mentioned data signal line driving circuit has such an advantage that the circuit structure is very simple, but suffers from the following drawbacks. Specifically, in this structure, since the picture signal needs to be applied to the data signal line DL within a 1-dot period or a short period of time that is about several times of the 1-dot period, it is necessary to lower the output impedance of an external picture signal generating circuit 75 for supplying a picture signal. Moreover, if the picture signal is a digital signal, it is necessary to provide a digital-to-analog converter and buffer amplifier for converting the digital signal into an analog signal before being input to the data signal line driving circuit. As a result, the circuit scale increases, and the overall power consumption of the system becomes higher considerably.

Besides, as described above, the sampling transistor used as the analog switch 73 is required to apply the picture signal to the data signal line DL within a short time. Therefore, in general, a considerably large transistor having a channel width of hundreds $\mu$m is required, though it depends on the characteristics of the element. In such a sampling transistor, the amount of charges stored in the channel region is very high, the charges in the channel region flows out to the data signal line DL at the time the sampling transistor becomes inactive, causing a fluctuation of the electric potential of the data signal line DL. Consequently, the input picture signal cannot be accurately applied to the data signal line DL.

On the other hand, in the structure of this embodiment, since the analog switches 14*a* through 14*h* do not become inactive, the electric potential of the source line SL can never fluctuate. Thus, an advantage of the structure of this embodiment is that it is possible to provide high quality images.

Additionally, according to the structure of this embodiment, since all of the pixel array 1, source driver 2 and gate driver 3 are formed on the insulating substrate 7, these elements can be produced in the same process. It is therefore possible to decrease the production cost and packaging cost, and improve the reliability.

Moreover, when the processing temperature set at a temperature not higher than 600° C., it is possible to use an inexpensive low-melt-point glass substrate as a material for the insulating substrate 7. As a result, a large-area liquid crystal display device can be achieved at low cost.

Furthermore, in this embodiment, the structure which includes a plurality of voltage generating circuits as gray-scale voltage generating means for generating gray-scale voltages of different levels and uses the gray-scale power supply 6 for generating gray-scale voltages of different levels, $V_1$ through $V_8$, is demonstrated as an example. However, the present invention is not limited by this structure. Then, referring to FIGS. 12 and 13, the following description will explain a modified example of the gray-scale voltage generating means.

Figure 12:
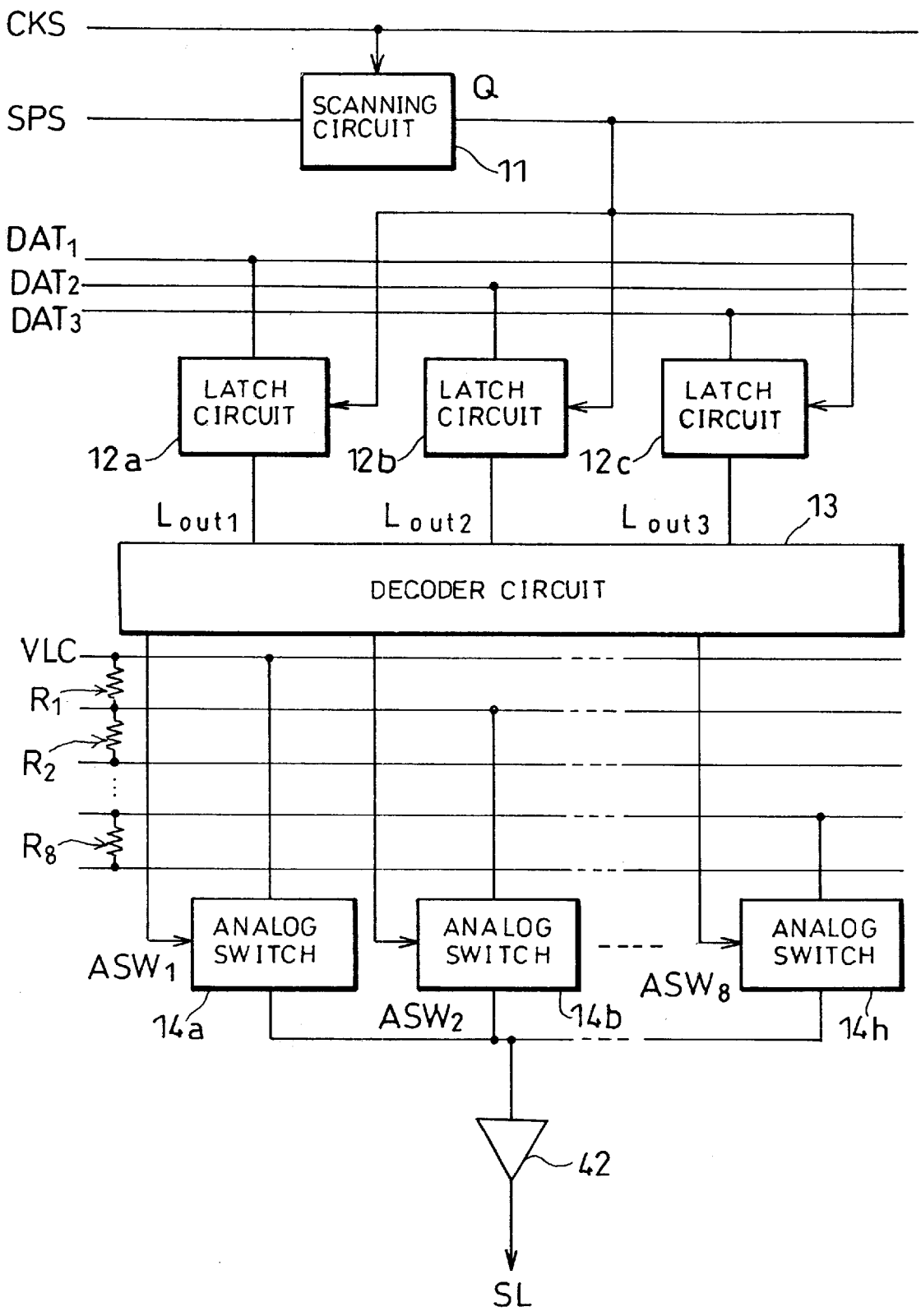
FIG. 12 is a block diagram showing a modified example of the structure for generating gray-scale voltages of different levels.

FIG. 12 shows the structure of a resistance type digital-to-analog converter. This convertor generates gray-scale voltages of different levels from reference voltages $V_{LC}$ and $V_{LC}'$ derived from one or two voltage generating circuit(s), using resistors $R_1$ through $R_8$. The gray-scale voltages are amplified by the amplifier 42, and applied to the source lines.

Since one resistance type digital-to-analog converter is usually mounted outside of the source driver, the number of input terminals from the gray-scale power supply can be decreased. It is thus possible to achieve a more compact source driver.

Figure 13:
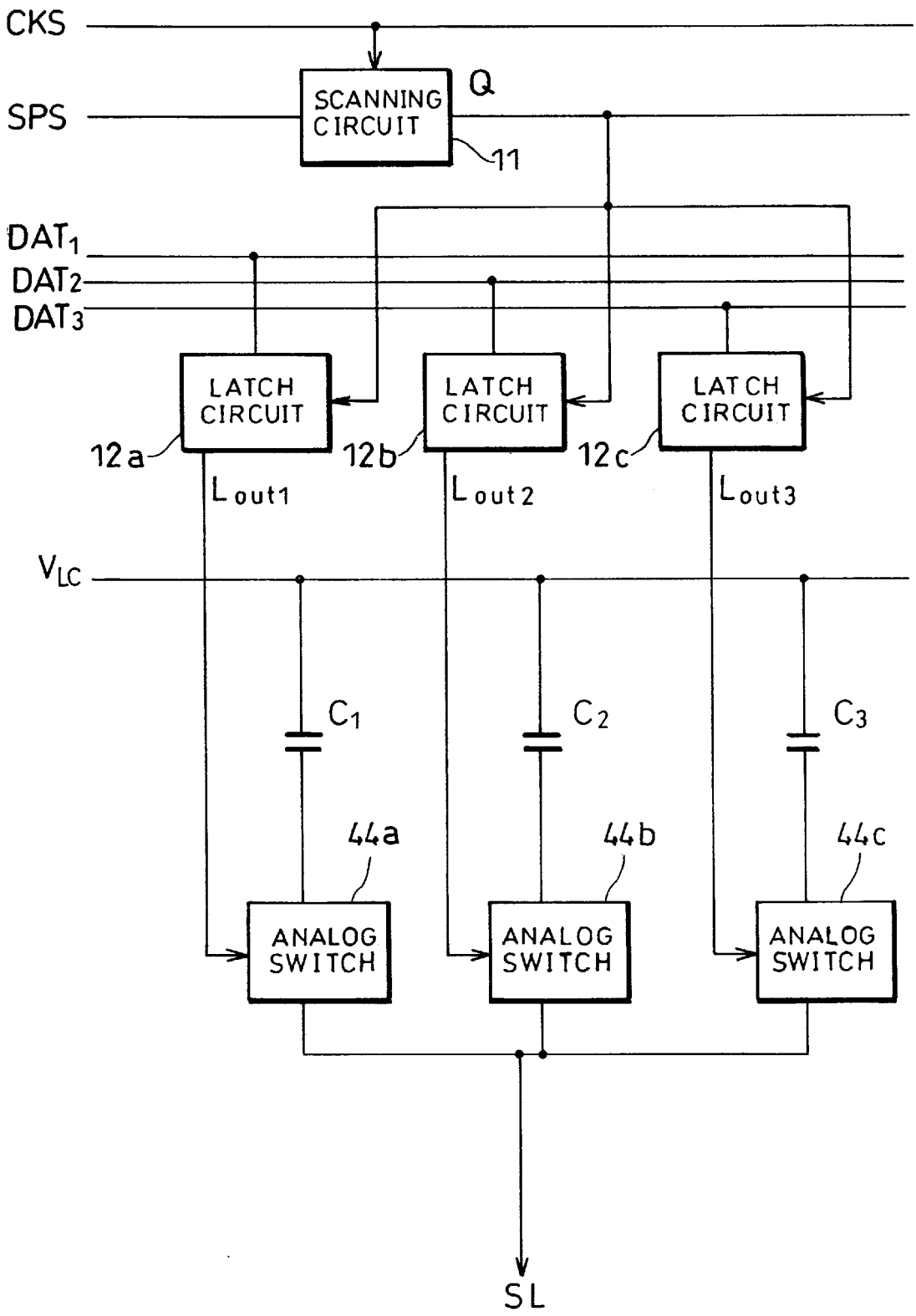
FIG. 13 is a block diagram showing another modified example of the structure for generating gray-scale voltages of different levels.

FIG. 13 shows the structure of a capacitance type digital-to-analog converter. This converter is usually provided for each output in the source driver. The capacitance type digital-to-analog converter includes three capacitors $C_1$ through $C_3$, and three analog switches 44*a* through 44*c*. The capacitances of the capacitors $C_1$ through $C_3$ are determined so that the desired 8 levels of the gray-scale voltages are applied to the source lines, according to a combination of ON/OFF states of the analog switches 44*a* through 44*c* corresponding to the output $L_{out1}$ through $L_{out3}$ from the latch circuits 12*a* through 12*c*. Accordingly, in the structure shown in FIG. 13, it is not necessary to provide a decoder on the output side of the latch circuits 12*a* through 12*c*.

In the case when the capacitance type digital-to-analog converter is used, it is possible to reduce the number of the input terminals from the gray-scale power supply and omit the decoder, thereby achieving a more compact source driver.

Embodiment 2

Figure 5:
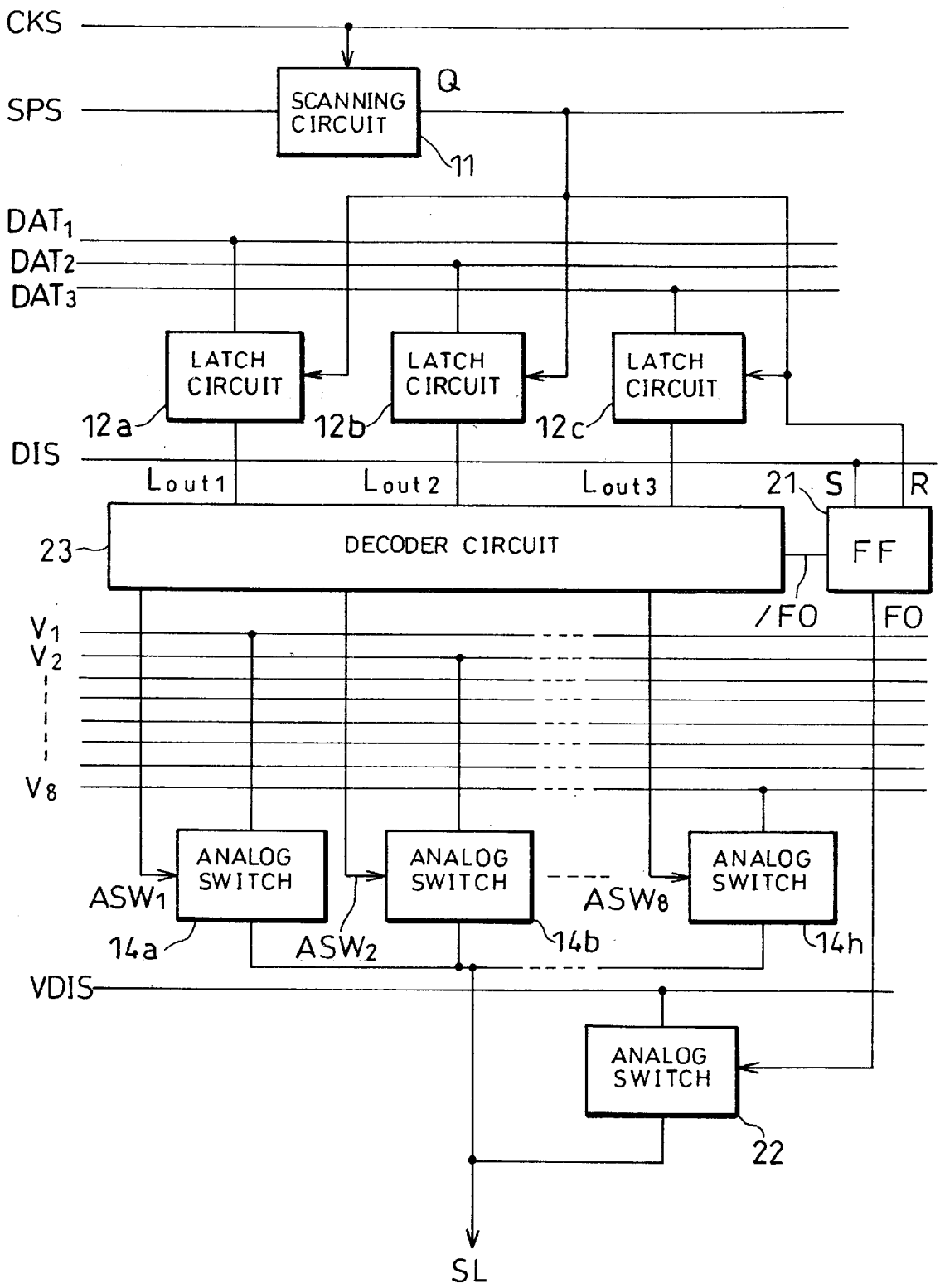
FIG. 5 is a block diagram showing the structure of a source driver of an active-matrix liquid crystal display device according to another embodiment of the present invention.
Figure 6:
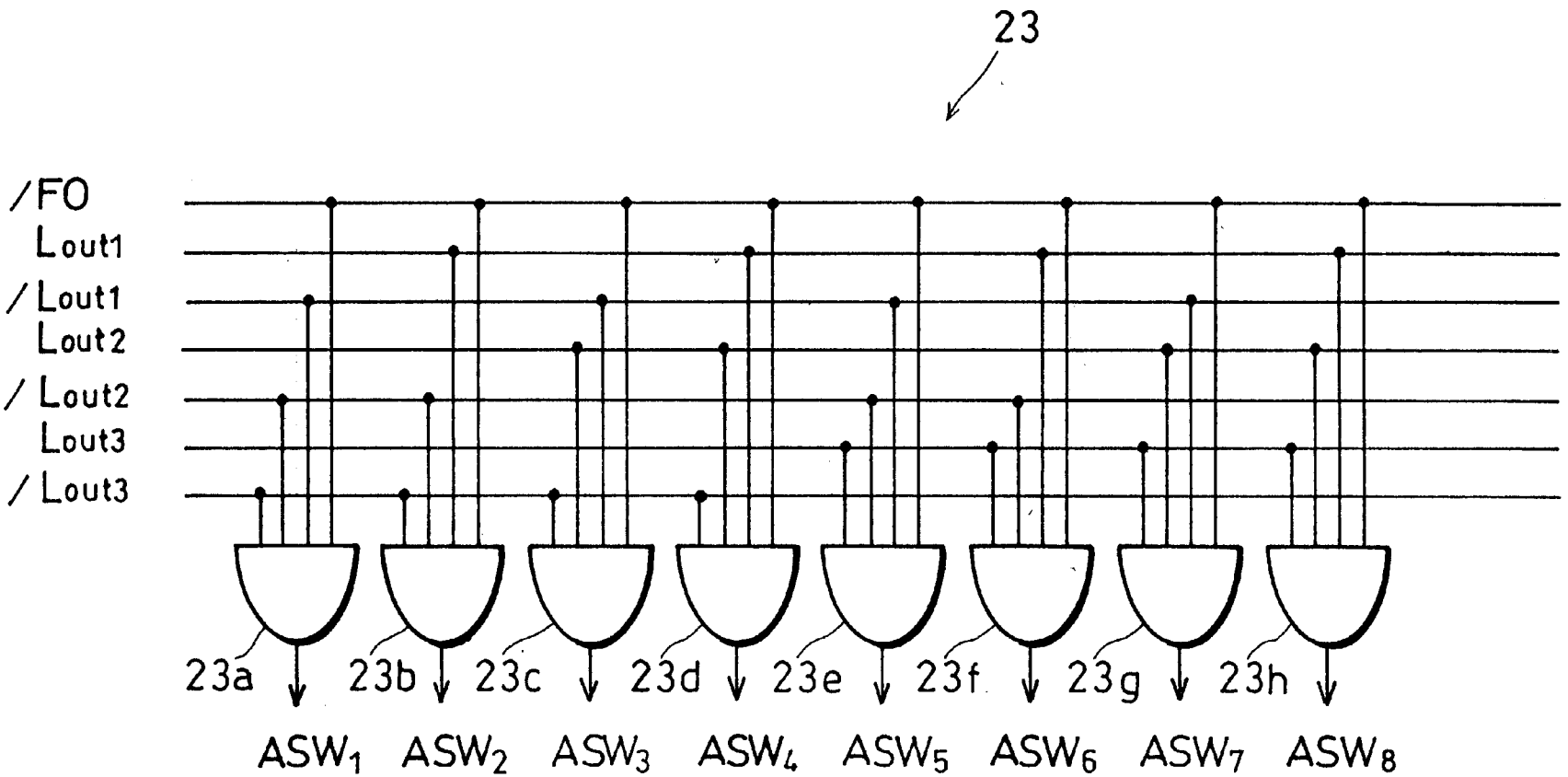
FIG. 6 is a circuit diagram showing the internal structure of a decoder circuit of the source driver shown in FIG. 5.
Figure 7:
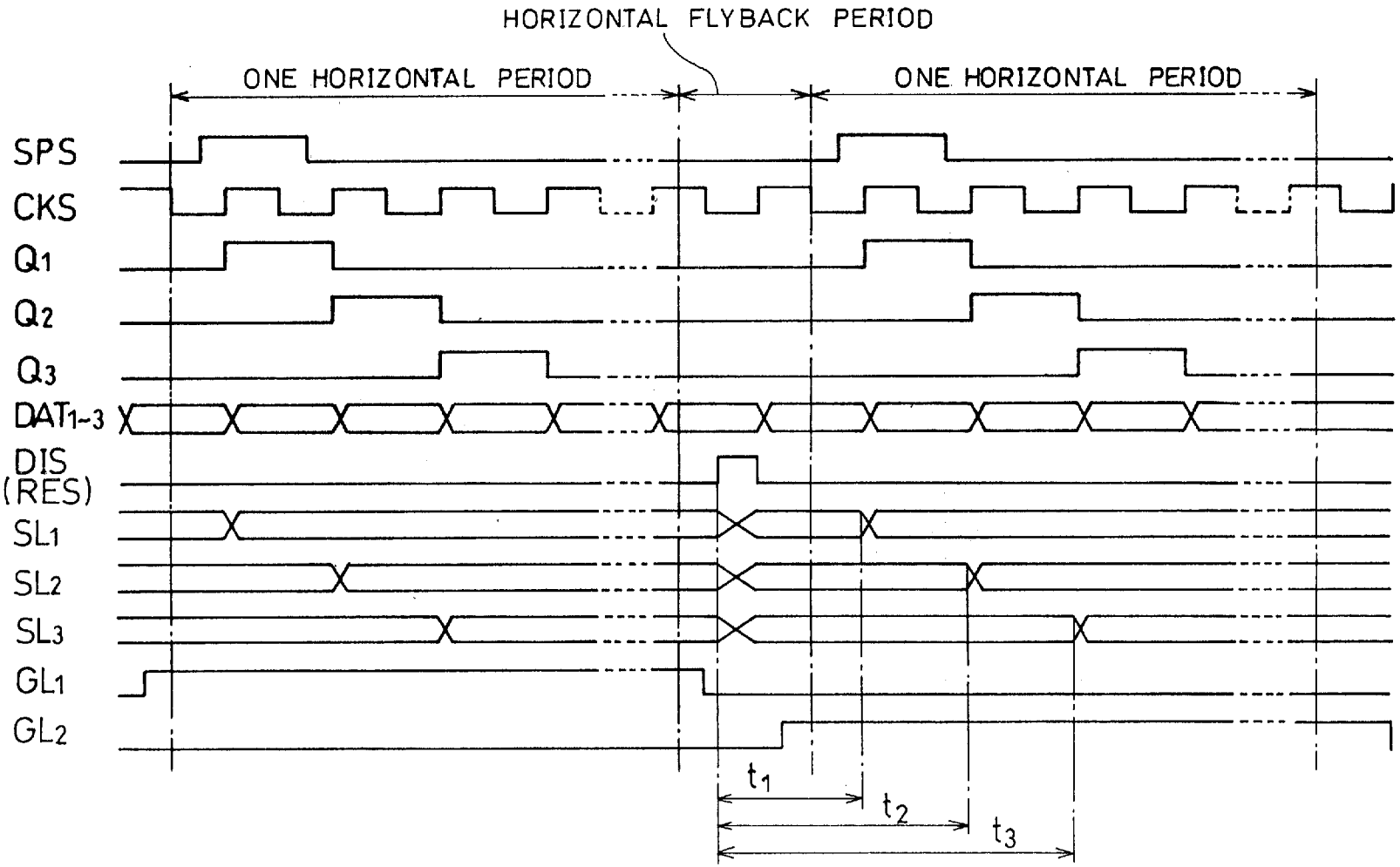
FIG. 7 is a timing chart showing the waveforms of input/output signals with respect to the source driver shown in FIG. 5, and the waveforms of signals in the source driver.

The following description will explain another embodiment of the present invention with reference to FIGS. 5 to 7. The structures having the same functions as those in Embodiment 1 will be designated by the same codes and their description will be omitted.

As illustrated in FIG. 5, the source driver 2 of a liquid crystal display device of this embodiment includes a decoder circuit 23 as discharging means for each source line SL, in place of the decoder circuit 13 of Embodiment 1. The explanation of the decoder circuit 23 will be given later. Furthermore, the source driver 2 of this embodiment has one SR flip-flop 21, and one discharge-use analog switch 22 in addition to the structure of Embodiment 1.

A discharge signal DIS is input to an input S of the SR flip-flop 21, while an output Q from the scanning circuit 11 is input to an input R thereof. An output FO of the SR flip-flop 21 is supplied to the discharge-use analog switch 22. Meanwhile, an output/FO of the SR flip-flop 21 is supplied to the decoder circuit 23 (hereinafter the inverted output of an output is represented by "/", for example, the inverted output of output A is indicated as "/A").

When the output FO from the SR flip-flop 21 is active, the discharge-use analog switch 22 is in a conducting state, fetches a discharge voltage VDIS, and outputs it to the source line SL.

For example, as shown in FIG. 6, the decoder circuit 23 can be formed by eight AND circuits 23*a* through 23*h*. The output/FO of the SR flip-flop 21 is input to the respective AND circuits, 23*a* through 23*h*. With this structure, only one of decoded signals $ASW_1$ through $ASW_8$ from the decoder circuit 23 becomes active only when the output/FO is active. Namely, when the output/FO is inactive, all of the decoded signals $ASW_1$ through $ASW_8$ from the decoder circuit 23 become inactive.

Next, with reference to the timing chart shown in FIG. 7, the following description will explain the operation of the source driver 2 of this embodiment. Here, in order to simplify the explanation, let's look at only three of the source lines, $SL_1$ through $SL_3$. In FIG. 7, $SL_1$ through $SL_3$ represent the waveforms of the signals output from the source driver 2 to the three source lines $SL_1$ through $SL_3$, respectively. Furthermore, $Q_1$ through $Q_3$ in FIG. 7 show the waveforms of the output signals from the scanning circuits 11 corresponding to the source lines $SL_1$ through $SL_3$, respectively, and $GL_1$ and $GL_2$ are the waveforms of signals output to the gate lines $GL_1$ and $GL_2$ from the gate driver 3, respectively.

The source driver 2 of this embodiment is operated in the same manner as that of Example 1, in the respective horizontal periods. On the other hand, in a horizontal flyback period, the discharge signal DIS is made active, and therefore the output FO and the output/FO of the SR flip-flop 21 become active and inactive, respectively.

Accordingly, the discharge-use analog switch 22 is in a conducting state, while all of the decoded signals $ASW_1$ through $ASW_8$ from the decoder circuit 23 become inactive. Consequently, all of the analog switches 14*a* through 14*h* become non-conducting state. Thus, in the horizontal flyback period, it is possible to apply the discharge voltage VDIS to all of the source lines SL through the discharge-use analog switch 22.

In the next horizontal period, when the output Q of the scanning circuit 11 becomes active, the output FO and the output/FO of the SR flip-flop 21 are made inactive and active, respectively. As a result, in contrast with the above-mentioned horizontal flyback period, the discharge-use analog switch 22 is in a non-conducting state, and one of the decoded signals $ASW_1$ through $ASW_8$ from the decoder circuit 23 becomes active. As a result, one of the analog switches 14*a* through 14*h* is in a conducting state. Accordingly, one of the gray-scale voltages $V_1$ through $V_8$ is selected, and output to the source lines SL.

As described above, in the source driver 2 of the liquid crystal display device of this embodiment, by once making the discharge signal DIS active within a horizontal flyback period, the discharge voltage VDIS is output to the source lines SL until the outputs Q of the scanning circuits 11 corresponding to the respective source lines SL become active in the next horizontal period. Here, a matter to be concerned is insufficient application of gray-scale voltage in the vicinity of the last source line SL to which the voltage application is performed last in a horizontal period (hereinafter just referred to as the "last source line") because the application time of the gray-scale voltage to the last source line is shortest. However, with the structure of this embodiment, since the discharge time with respect to the last source line is longest (substantially one horizontal period), the discharge voltage VDIS compensates for the insufficient application of the gray-scale voltage. As a result, the gray-scale voltage is sufficiently applied to all of the source lines SL, thereby achieving high-quality displays.

Regarding source lines SL to which the gray-scale voltage is applied at early stages of a horizontal period, since the application time of the gray-scale voltage to these source lines SL is sufficient, there is no problem even if the discharge to these source lines SL is insufficient. Specifically, since the power supply circuit for supplying the discharge voltage is a supplemental structure for compensating for insufficient voltage application, it is only necessary for the power supply circuit to have a driving force sufficient for applying the discharge voltage VDIS within a horizontal period. Namely, the power supply circuit is not required to have a driving force as high as that of, for example, the gray-scale power supply 6.

Besides, in this embodiment, it is possible to generate the gray-scale voltage using one or two voltage generator(s) and a resistance type digital-to-analog converter or capacitance type digital-to-analog converter shown in FIG. 12 or 13 as explained in Embodiment 1, instead of the gray-scale power supply 6 that generates gray-scale voltages of different levels, $V_1$ through $V_8$, using a plurality of voltage generating circuits. In this case, it is possible to achieve a more compact source driver.

Figure 14:
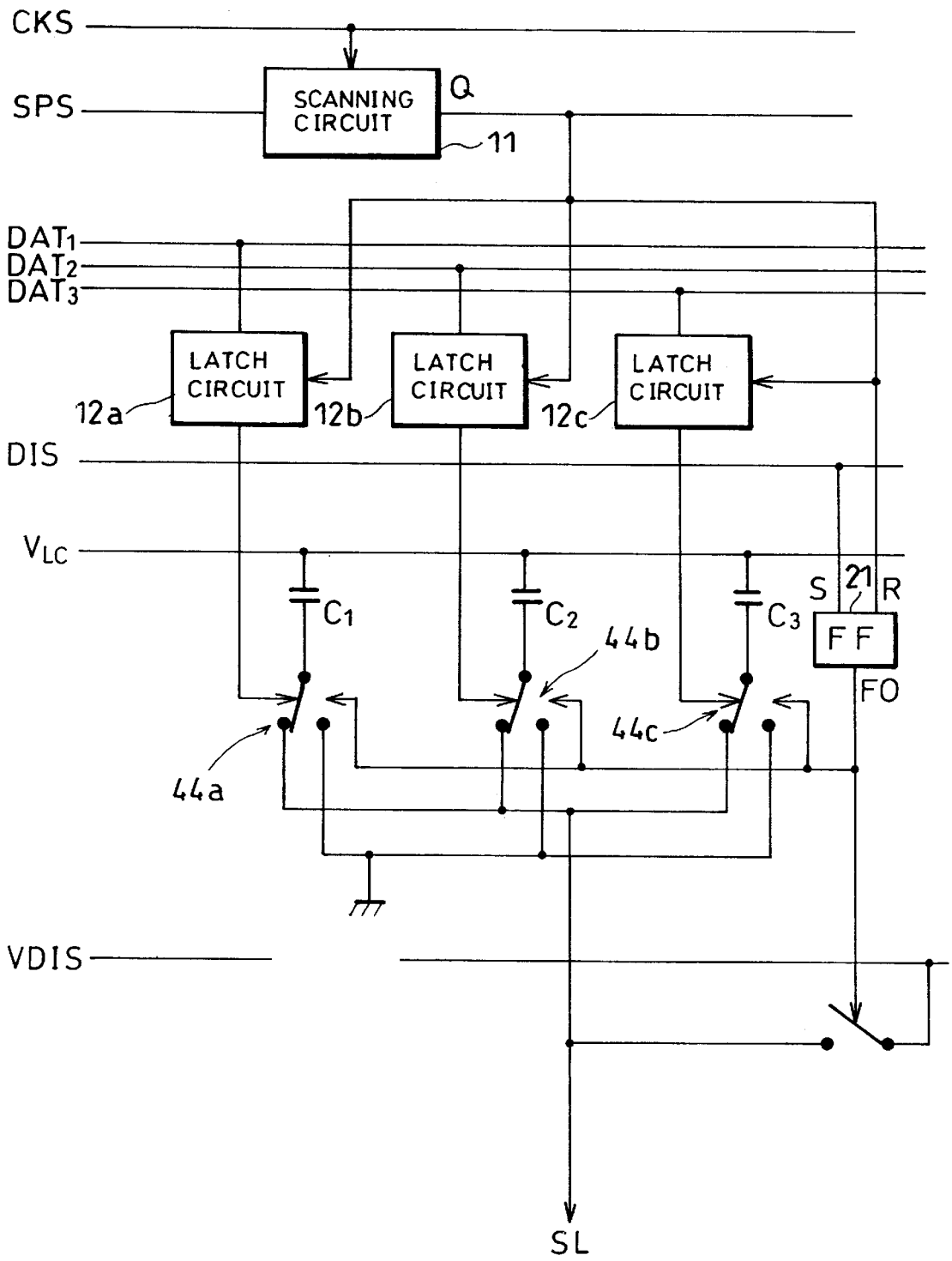
FIG. 14 is a block diagram showing still another modified example of the structure for generating gray-scale voltages of different levels.
Figure 15:
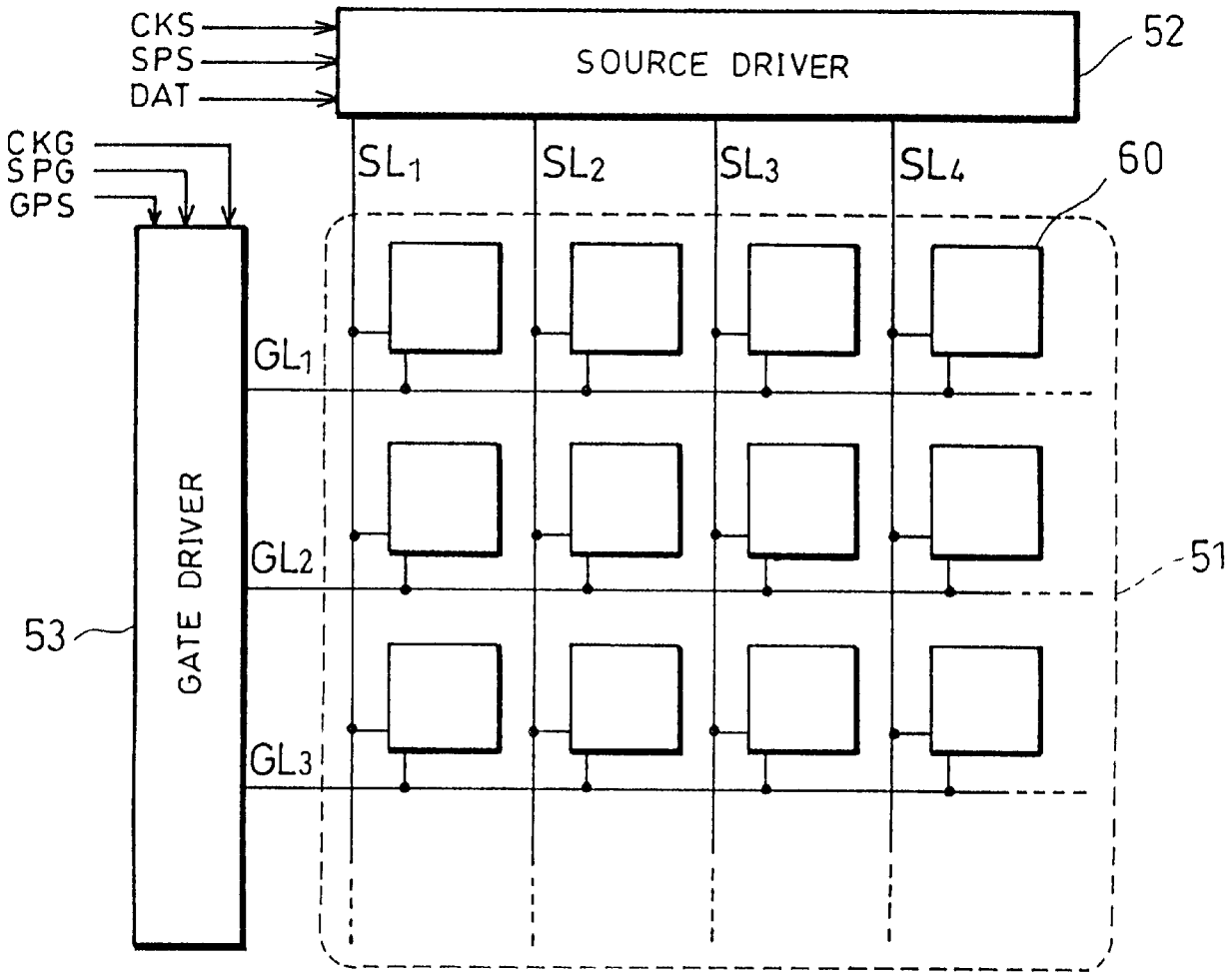
FIG. 15 PRIOR ART
FIG. 15 is a block diagram showing a schematic structure of a conventional active-matrix liquid crystal display device.
Figure 16:
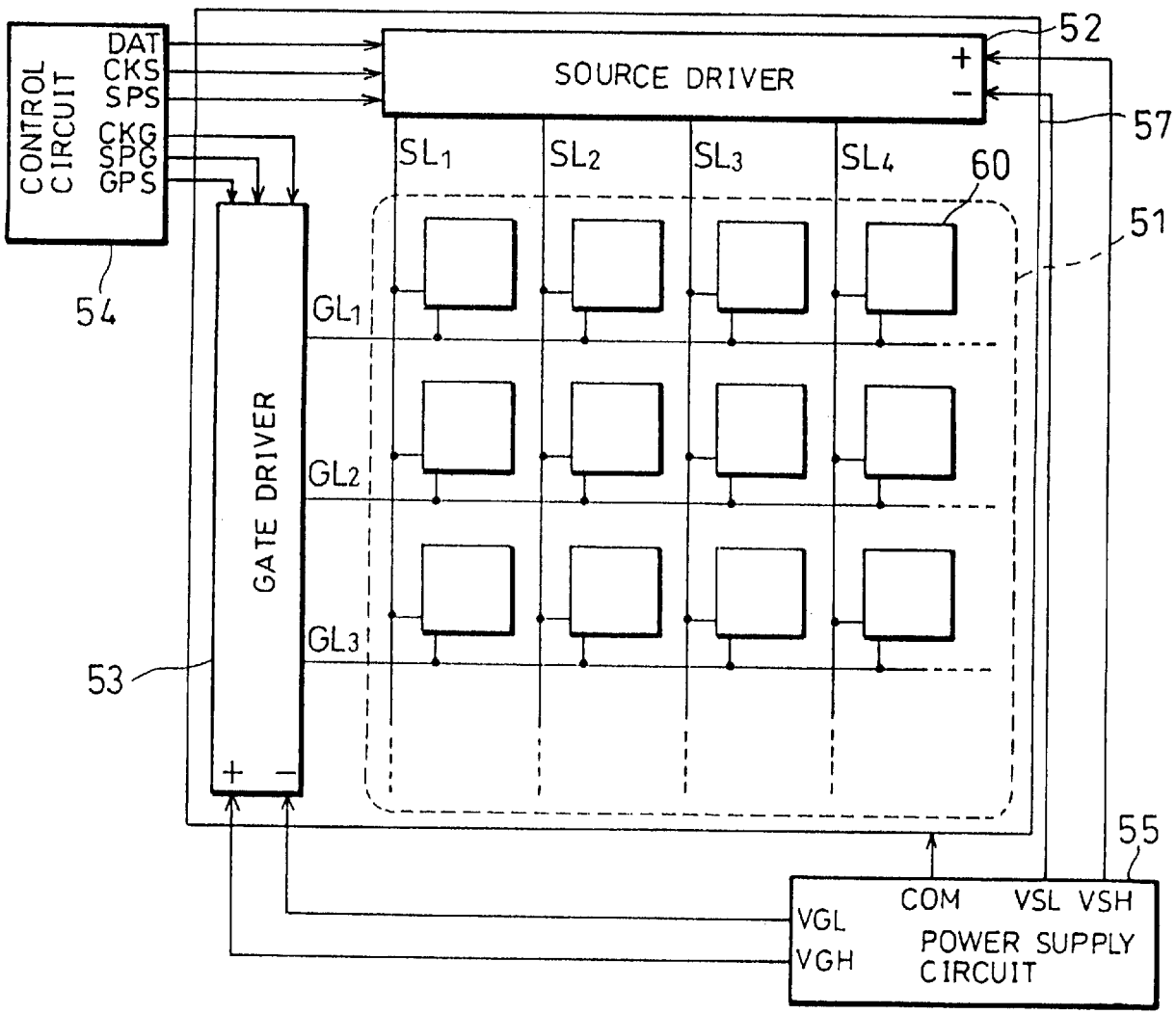
FIG. 16 PRIOR ART
FIG. 16 is a block diagram showing a structure of a conventional active-matrix liquid crystal display device adopting a monolithic structure formed by arranging a source driver and a gate driver on a single substrate whereon a pixel array is formed.
Figure 17:
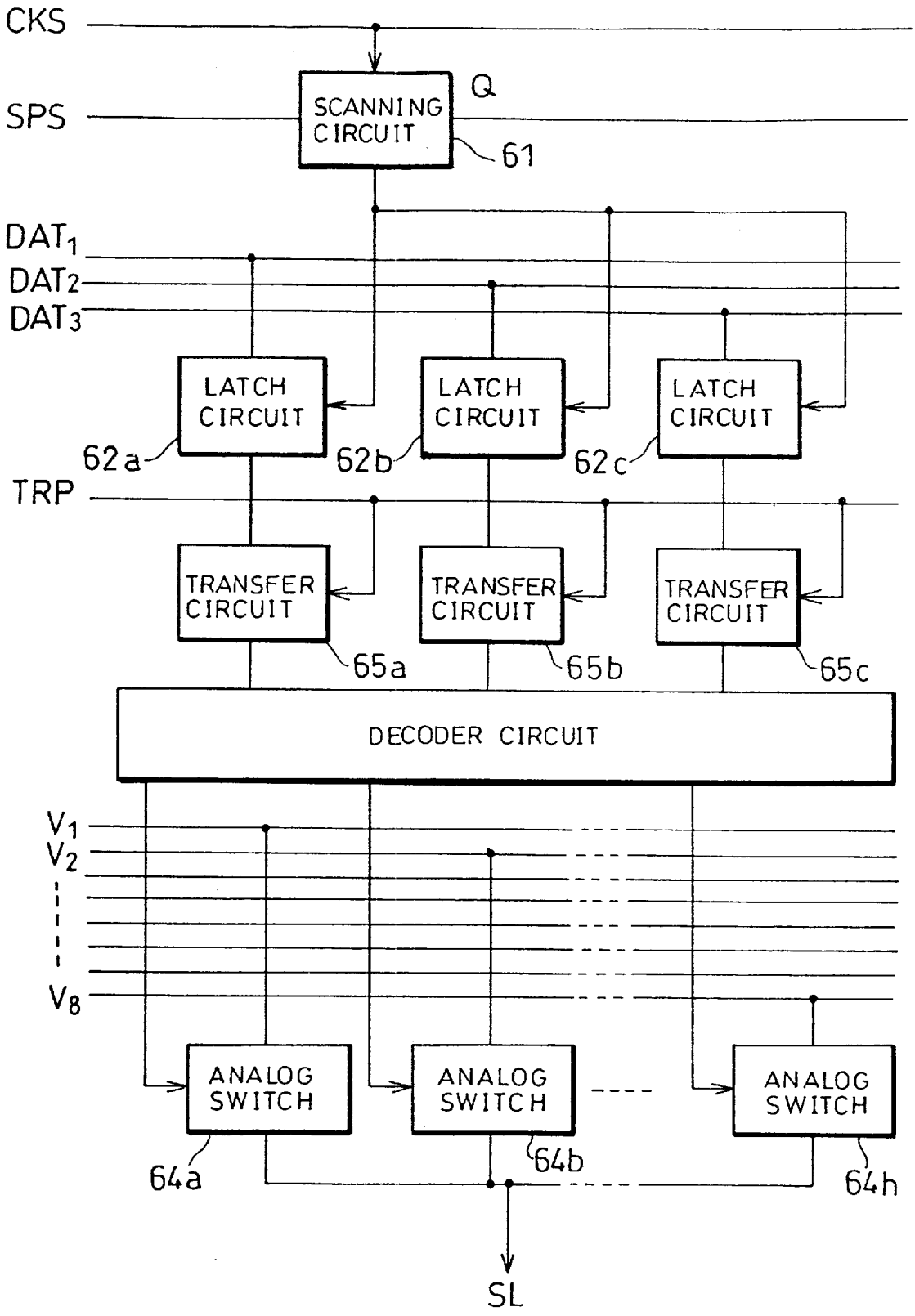
FIG. 17 PRIOR ART
FIG. 17 is a block diagram showing the structure of the source driver of the conventional active-matrix liquid crystal display shown in FIG. 16.
Figure 18:
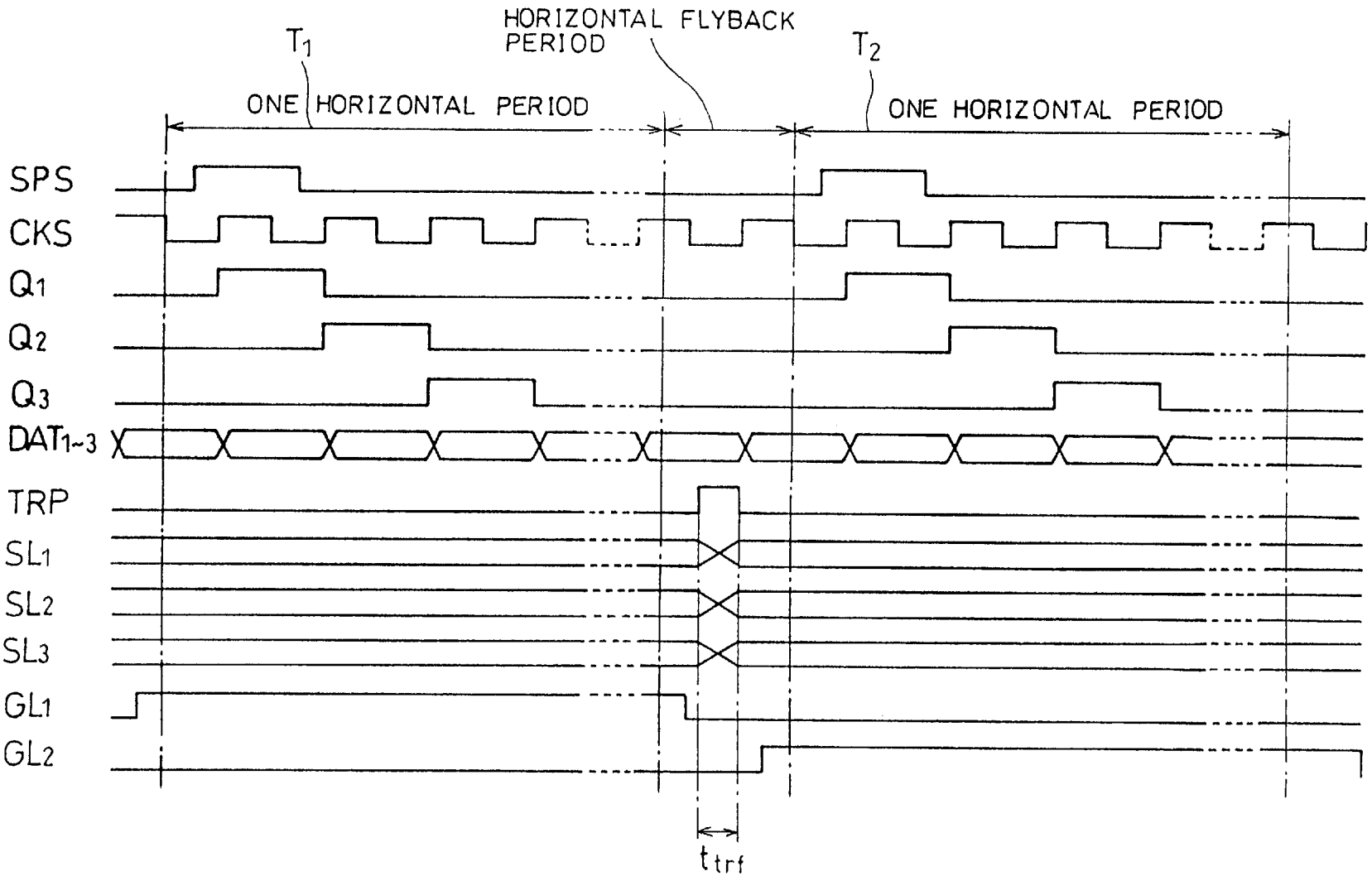
FIG. 18 PRIOR ART
FIG. 18 is a timing chart showing the waveforms of input/output signals with respect to the source driver shown in FIG. 17, and the waveforms of signals in the source driver.

FIG. 14 shows a structure where a capacitance type digital-to-analog converter is used for the source driver of this embodiment. In this structure, the output/FO of the SR flip-flop 21 is not used.

Embodiment 3

The following description will explain still another embodiment of the present invention with reference to FIGS. 8 to 11. The structures having the same functions as those in the above-mentioned embodiments will be designated by the same codes and their description will be omitted.

Figure 8:
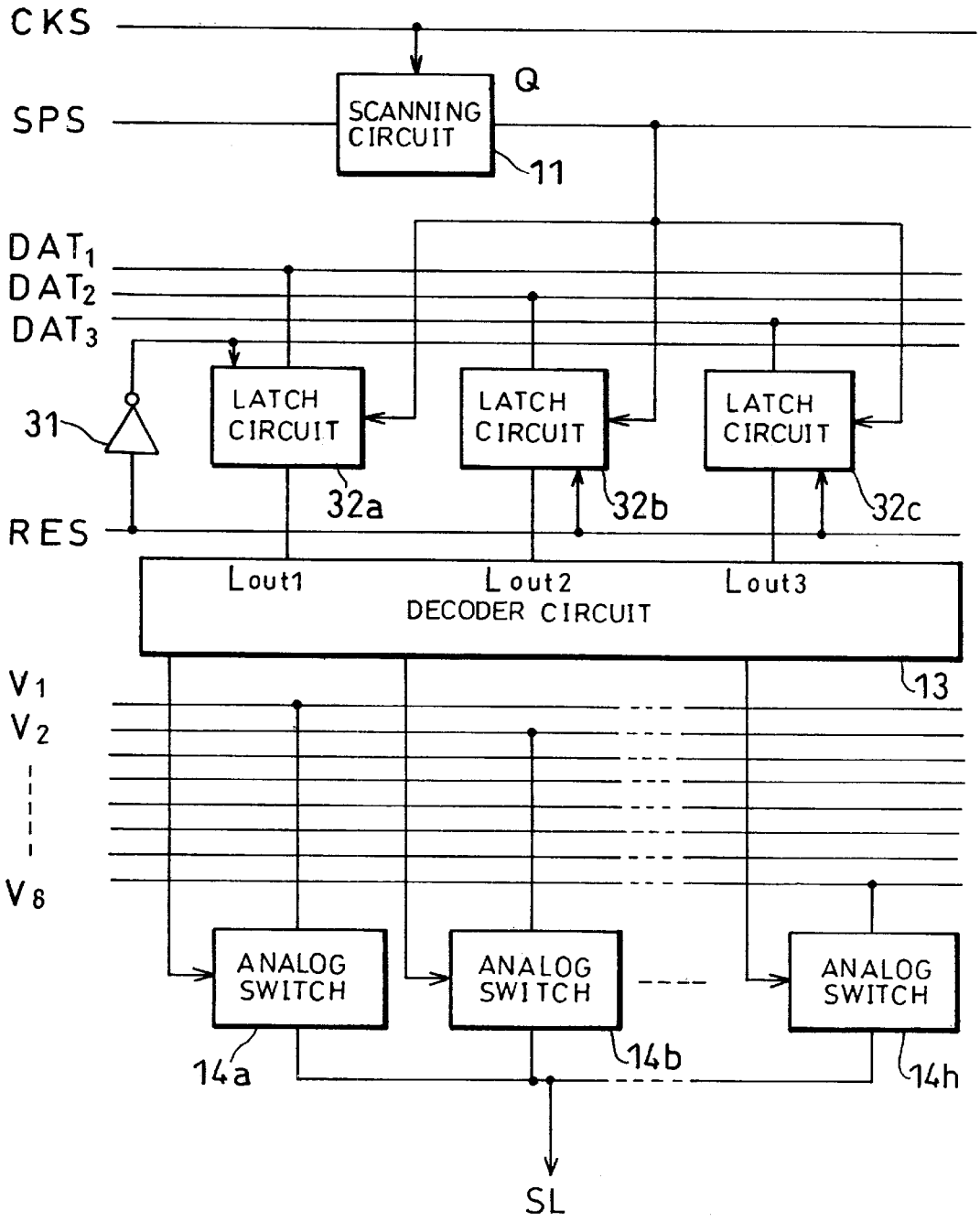
FIG. 8 is a block diagram showing the structure of a source driver of an active-matrix liquid crystal display device according to still another embodiment of the present invention.

As illustrated in FIG. 8, the source driver 2 of a liquid crystal display device of this embodiment includes latch circuits 32*a*, 32*b*, 32*c* for each source line SL, instead of the latch circuits 12*a*, 12*b*, 12*c* explained in Embodiment 1. In addition, the source driver 2 of this embodiment has an inverter 31. Like the structure explained in Embodiment 2, the source driver 2 of this embodiment applies the discharge voltage to the source lines SL. However, the source driver 2 of Embodiment 3 is distinguished from that of Embodiment 2 in its structure that one of the gray-scale voltages is used as the discharge voltage.

Figure 9:
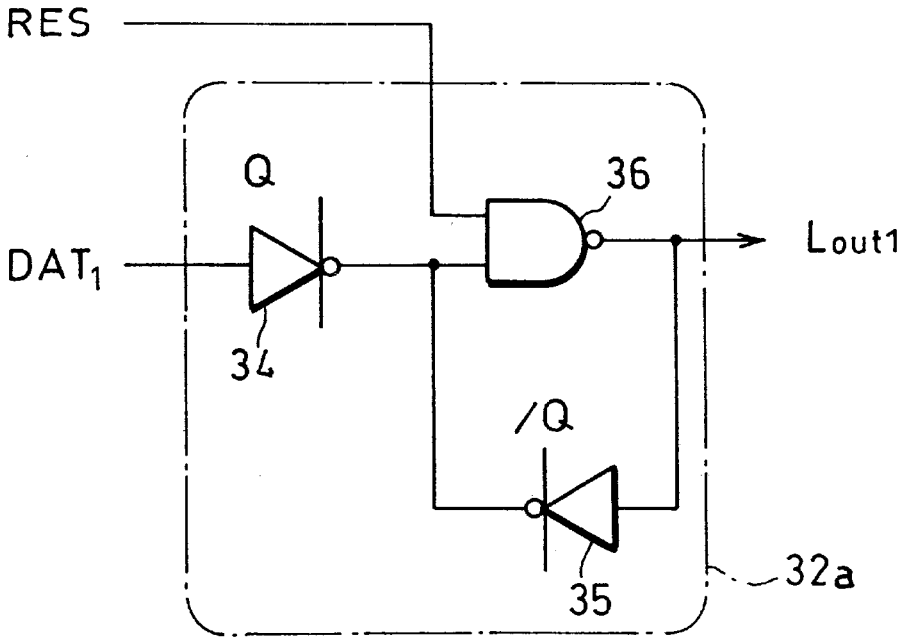
FIG. 9 is a circuit diagram showing the internal structure of a latch circuit for fetching the highest bit of a picture signal in the source driver shown in FIG. 8.
Figure 10:
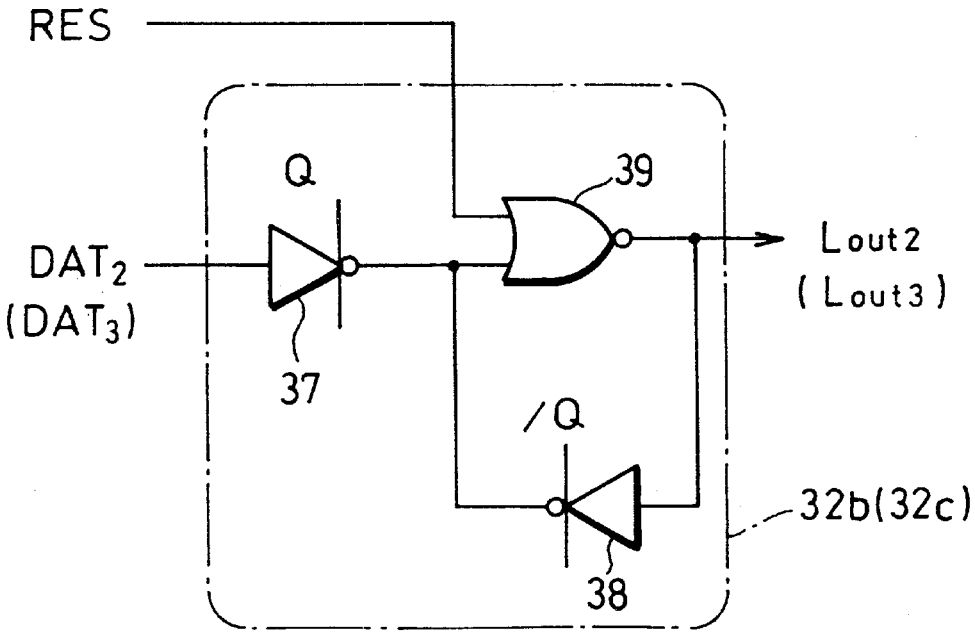
FIG. 10 is a circuit diagram showing the internal structure of a latch circuit for fetching the lower bits of a picture signal in the source driver shown in FIG. 8.

Regarding the latch circuits 32*a*, 32*b* and 32*c*, the latch circuit 32*a* for latching the highest bit ($DAT_1$) is provided with a set function, and includes clocked inverters 34 and 35, and a NAND circuit 36 as shown in FIG. 9. On the other hand, the latch circuits 32*b*, 32*c* for latching the lower two bits ($DAT_2$, $DAT_3$) have a reset function, and include clocked inverters 37 and 38, and a NOR circuit 39 as shown in FIG. 10. A reset signal RES is applied to the latch circuits 32*b* and 32*c*, while an inverted reset signal RES is applied through the inverter 31 to the latch circuit 32*a*.

The waveforms of the signals output to the source lines SL from the source driver 2 of this embodiment are the same as those of Embodiment 2. Specifically, as shown in FIG. 7, when the reset signal RES is active in a horizontal flyback period, the latch circuit 32*a* becomes active, while the latch circuits 32*b*, 32*c* become inactive. Namely, the outputs ($L_{out\,1}$, $L_{out2}$, $L_{out3}$) of the latch circuits 32*a*, 32*b*, 32*c* are (1, 0, 0).

The relationship between the outputs ($L_{out1}$, $L_{out2}$, $L_{out3}$) from the latch circuits 32*a*, 32*b*, 32*c*, and the gray-scale voltages selected according to these outputs (selected voltages) is shown in FIG. 11. More specifically, by making one of the decoded signals $ASW_1$ through $ASW_8$ to be output to the analog switches 14*a* through 14*h* from the decoder circuit 13 active according to the outputs ($L_{out1}$, $L_{out2}$, $L_{out3}$), only one of the analog switches 14*a* through 14*h* becomes a conducting state. As a result, one of the gray-scale voltages $V_1$ through $V_8$ is selected. In this case, the outputs ($L_{out1}$, $L_{out2}$, $L_{out3}$) are (1, 0, 0). Therefore, as clear from FIG. 11, only the analog switch 14*e* is in a conducting state, and the gray-scale voltage $V_5$ is selected and output to the source line SL.

In the next horizontal period, the gray-scale voltage $V_5$ continues to be output as the discharge voltage to the source lines SL until the outputs Q of the scanning circuits 11 become active and the digital picture signals DAT are fetched again. For example, after the reset signal RES becomes active in a horizontal flyback period, the gray-scale voltage $V_5$ continues to be output to the source lines $SL_1$ through $SL_3$ shown in FIG. 7 for the periods of time $t_1$, $t_2$, $t_3$, respectively.

As described above, in the source driver 2 of the liquid crystal display device of this embodiment, by once making the reset signal RES active within a horizontal flyback period, one of the gray-scale voltages is output as the discharge voltage to the source lines SL until the outputs Q of the scanning circuits 11 corresponding to the source lines SL become active in the next horizontal period.

Accordingly, with the structure of Embodiment 3, like the structure explained in Embodiment 2, the discharge voltage is applied to the source lines SL in a period of time from a horizontal flyback period to the start of application of the gray-scale voltage in the next horizontal period. In the next horizontal period, it is only necessary to apply the difference between the discharge voltage VDIS and the gray-scale voltage $V_x$ corresponding to the digital picture signal DAT to the source lines SL. It is therefore possible to shorten the application time to the source lines SL, and prevent insufficient application of the gray-scale voltage.

Moreover, with the structure of Embodiment 3, there is no need to additionally provide a power supply for generating the discharge voltage VDIS. Thus, this structure has advantages of reducing the power consumption and decreasing the circuit scale over the structure explained in Embodiment 2.

Besides, in Embodiment 3, the gray-scale voltage $V_5$ is used as the discharge voltage. As explained in Embodiment 2, the electric potential of discharge needs to be set at a value sufficient for applying the discharge voltage to the last source line within substantially one horizontal period. Furthermore, the electric potential effective for discharge varies depending on the driving method of liquid crystals, the electric potential of the common electrode, or the characteristics of the switching element. Therefore, it is preferred to design the latch circuits 32*a*, 32*b*, 32*c* so that the outputs ($L_{out1}$, $L_{out2}$, $L_{out3}$) of the latch circuits 32*a*, 32*b*, 32*c* select a gray-scale voltage of a suitable electric potential as the discharge voltage.

In Embodiment 3, it is possible to use a resistance type digital-to-analog converter or capacitance type digital-to-analog converter shown in FIG. 12 or 13 as explained in Embodiment 1, instead of the gray-scale power supply 6 that generates gray-scale voltages of different levels, $V_1$ through $V_8$, using a plurality of voltage generating circuits. In this case, it is possible to achieve a more compact source driver.

As explained in the above-mentioned embodiments, the active-matrix-type image display device according to the present invention includes the gray-scale voltage generating means for generating gray-scale voltages of different levels, the scanning signal line driving circuit for outputting a scanning voltage to the scanning signals lines, and the data signal line driving circuit for selecting a gray-scale voltage according to a picture signal and outputting the gray-scale voltage to the data signals lines, and is characterized by that the data signal line driving circuit has one scanning circuit for each data signal line, and the scanning circuits selectively output the gray-scale voltage to the data signal lines in synchronization with the sequential outputs of the active signals from the scanning circuits in one horizontal period.

With this structure, since the peak of the current flowing in a gray-scale power supply line for supplying the gray-scale voltages to the data signal line driving circuit from the gray-scale voltage generating means is spread, a lower driving force is required by the gray-scale voltage generating means. As a result, the power consumption of the gray-scale voltage generating means is reduced, thereby achieving a low-power-consuming active-matrix-type image display device.

The above-mentioned active-matrix-type image display device can be constructed so that the gray-scale voltage corresponding to the picture signal fetched in a horizontal period continues to be output to the data signal lines from the data signal line driving circuit until the picture signal is fetched in the next horizontal period.

With this structure, it is possible to use a time substantially equal to one horizontal period as the application time of the gray-scale voltages to the data signal lines, thereby preventing insufficient application of the gray-scale voltages to the data signal lines. Therefore, an effect of producing high-quality images is obtained in addition to the above-mentioned effect. Another advantage of this structure is that the electric potential of the data signal line does not vary.

The above-mentioned active-matrix-type image display device may employ a data signal line driving circuit having discharge means for applying a discharge voltage to each data signal line.

With this structure, insufficient application of the gray-scale voltage to a data signal line due to a short application time of the gray-scale voltage to the data signal line is compensated by the discharge voltage. As a result, sufficient voltage application is performed for all of the data signal lines, thereby proving high-quality images.

As the discharge voltage, it is possible to use one of the gray-scale voltages generated by the gray-scale voltage generating means.

With this structure, since there is no need to additionally provide a power supply for generating the discharge voltage, it is possible to use an existing gray-scale power supply. Consequently, the voltage is sufficiently applied to all of the data signal lines without increasing the power consumption and circuit structure. Accordingly, it is possible to further reduce the power consumption and size of the active-matrix-type image display device.

Furthermore, the discharge means can include a latch circuit which inputs the discharge signal and picture signal and is set or reset when the discharge signal is active, and a selecting circuit for selecting and outputting one of the gray-scale voltages according to the output of the latch circuit, and be constructed so that the latch circuit outputs a signal for selecting a gray-scale voltage used as the discharge voltage to the selecting circuit when the discharge signal is active, and outputs a signal for selecting the gray-scale voltage corresponding to the picture signal to the selecting circuit when the discharge signal is inactive.

Accordingly, it is possible to achieve a data signal line driving circuit having a discharge function with a simple structure. As a result, an effect of further reducing the size of the active-matrix-type image display device is produced.

The above-mentioned active-matrix-type image display device can be constructed so that a switching element formed of a polycrystalline silicone thin-film transistor is provided for each pixel, and the data signal line driving circuit and the scanning signal line driving circuit include the polycrystalline silicone thin-film transistors.

With this structure, it is also possible to sufficiently apply the gray-scale voltage to a data signal line subjected to a short application time of the gray-scale voltage. As a result, an effect of producing high-quality images is obtained.

The above-mentioned active-matrix-type image display device can be constructed so that the pixels, data signal line driving circuit and scanning signal line driving circuit are formed on a single substrate.

With this structure, it is possible to decrease the production cost and the packaging cost, and improve the reliability.

The above-mentioned active-matrix-type image display device can use a glass substrate as the substrate. In this case, it is preferred to set the maximum temperature in the process of producing the pixels, data signal line driving circuit and scanning signal line driving circuit at 600° C. or lower temperatures.

With this arrangement, it is possible to use an inexpensive low-melting-point glass substrate, thereby achieving a further reduction in the cost of producing the active-matrix-type image display device.

In the above-mentioned active-matrix-type image display device, the data signal line driving circuit can be constructed using a scanning circuit, latch circuit, and data signal line output circuit.

With this structure, it is possible to reduce the circuit scale of the data signal line driving circuit. Besides, in the case when the driving circuit is formed by using a polycrystalline silicone film that is subject to stricter design rules compared to an LSI, the circuit area can be significantly decreased. Thus, this circuit structure is very effective for the decrease in the area of the periphery section (frame section) of the display device, and reduction in the production cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An active-matrix-type image display device for inputting a digital picture signal, said device comprising:

a plurality of pixels arranged in a matrix form;

a plurality of data signal lines arranged to correspond to columns of said pixels; and a plurality of scanning signal lines arranged to correspond to rows of said pixels, said active-matrix-type image display device further comprising:

gray-scale voltage generating means for generating gray-scale voltages of different levels;

a scanning signal line driving circuit for outputting a scanning voltage to said scanning signal lines; and a data signal line driving circuit for selecting a gray-scale voltage according to the picture signal and outputting the selected gray-scale voltage sequentially to each of said data signal lines, wherein said data signal line driving circuit includes one scanning circuit for each of said data signal lines, and outputs a selected gray-scale voltages to each of said data signal lines at different start timings sequentially in one horizontal image display period in synchronization with sequential outputs of active signals from said scanning circuits in said one horizontal image display period.

2. The active-matrix-type image display device as set forth in claim 1, wherein a gray-scale voltage corresponding to a picture signal fetched in each horizontal period continues to be output to each of said data signal lines from said data signal line driving circuit until a next picture signal is fetched in a next horizontal period.

3. The active-matrix-type image display device as set forth in claim 1, wherein said data signal line driving circuit includes discharge means for applying a discharge voltage to each of said data signal lines.

4. The active-matrix-type image display device as set forth in claim 3, wherein one of gray-scale voltages generated by said gray-scale voltage generating means is used as the discharge voltage.

5. The active-matrix-type image display device as set forth in claim 4, wherein said discharge means includes a latch circuit which inputs a discharge signal and a picture signal and is set or reset when the discharge signal is active, and a selecting circuit for selecting one of the gray-scale voltages according to an output from said latch circuit and for outputting the gray-scale voltage to said data signal line, and said latch circuit outputs a signal for selecting a gray-scale voltage used as the discharge signal to said selecting circuit when the discharge signal is active, and outputs a signal for selecting a gray-scale voltage corresponding to the picture signal to said selecting circuit when the discharge signal is inactive.

6. The active-matrix-type image display device as set forth in claim 1, further comprising a switching element formed of a polycrystalline silicone thin-film transistor in each of said pixels, wherein said data signal line driving circuit and scanning signal line driving circuit include polycrystalline silicone thin-film transistors.

7. The active-matrix-type image display device as set forth in claim 1, wherein said pixels, data signal line driving circuit, and scanning signal line driving circuit are formed on a single substrate.

8. The active-matrix-type image display device as set forth in claim 7, wherein said substrate is a glass substrate, and a maximum temperature in a process of producing said pixels, data signal line driving circuit, and scanning signal line driving circuit is 600° C. or lower temperatures.

9. The active-matrix-type image display device as set forth in claim 1, wherein, when the digital picture signal is n bits, said data signal line driving circuit includes one scanning circuit, n latch circuits, and one data signal line output circuit for each of said data signal lines.

10. The active-matrix-type image display device as set forth in claim 9, wherein said data signal line output circuit, includes $2^n$ AND circuits, and $2^n$ analog switches.

11. The active-matrix-type image display device as set forth in claim 1, wherein said gray-scale voltage generating means is a resistance type digital-to-analog converter.

12. The active-matrix-type image display device as set forth in claim 1, wherein said gray-scale voltage generating means is a capacitance digital-to-analog converter.

13. The active-type-image display device as set forth in claim 1, further comprising a liquid crystal layer for modulating transmittance of light in said pixels.

14. An active-matrix-type image display device, said device comprising:

a plurality of pixels arranged in a matrix form;

a plurality of data signal lines arranged to correspond to columns of said pixels; and a plurality of scanning signal lines arranged to correspond to rows of said pixels, said active-matrix-type image display device further comprising:

gray-scale voltage generating means for generating gray-scale voltages of different levels;

a scanning signal line driving circuit for outputting a scanning voltage to said scanning signal lines; and a data signal line driving circuit for selecting a gray-scale voltage according to the picture signal and outputting the selected gray-scale voltage to each of said data signal lines, wherein, in order that said selected gray scale voltages are outputted to each data signal line at different start timings in one horizontal image display period, said data signal line driving circuit includes a timing generating section for generating timing signals for shifting timings to output the gray scale voltage to said data signal lines sequentially in said one horizontal image display period.

15. The active-matrix-type image display device as set forth in claim 14, wherein said data signal line driving circuit includes discharge means for applying to each of said data signal lines a discharge voltage for compensating for insufficient application of the gray-scale voltage to that data signal line.

16. The active-matrix-type image display device as set forth in claim 15, wherein a period of time in which said discharge means applies the discharge voltage to each of said data signal lines is specified to increase with a decrease in a period of time in which the gray-scale voltage is applied to that data signal line.

17. The active-matrix-type image display device as set forth in claim 15, wherein said discharge means includes a switching circuit for starting application of the discharge voltage in a horizontal flyback period and ending the application of the discharge voltage sequentially with respect to said data signal lines in synchronization with outputs of the timing signals generated by said timing generating means.

* * * * *